US009463632B2

(12) United States Patent
Takagiwa

(10) Patent No.: US 9,463,632 B2
(45) Date of Patent: Oct. 11, 2016

(54) PRINT DEVICE

(71) Applicant: BROTHER KOGYO KABUSHIKI KAISHA, Nagoya-shi, Aichi-ken (JP)

(72) Inventor: Yutaka Takagiwa, Kariya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/858,643

(22) Filed: Sep. 18, 2015

(65) Prior Publication Data

US 2016/0082739 A1 Mar. 24, 2016

(30) Foreign Application Priority Data

Sep. 24, 2014 (JP) ..... 2014-194246

(51) Int. Cl.
*B41J 2/175* (2006.01)

(52) U.S. Cl.
CPC ..... *B41J 2/17513* (2013.01); *B41J 2/175* (2013.01); *B41J 2002/17516* (2013.01)

(58) Field of Classification Search
CPC .... B41J 2/175; B41J 2/17509; B41J 2/1752; B41J 2/17553; B41J 2002/17516
See application file for complete search history.

(56) References Cited

U.S. PATENT DOCUMENTS 5,485,187 A * 1/1996 Okamura ..... B41J 2/175 347/85
6,196,668 B1 * 3/2001 Bode ..... B41J 2/175 347/85
2002/0113852 A1 8/2002 Kimura et al.
2002/0158954 A1 10/2002 Usui et al.

FOREIGN PATENT DOCUMENTS

JP 2003-159809 A 6/2003

* cited by examiner

*Primary Examiner* — Geoffrey Mruk
(74) *Attorney, Agent, or Firm* — Fox Rothschild LLP

(57) ABSTRACT

A print device includes mount portions, flow passages and reservoir portions. The mount portion mounts a container containing liquid. The flow passage connects the mount portion to a head portion having a nozzle face. The reservoir portion provided on the flow passage reserves liquid and is located such that a distance from the nozzle face in the up-down direction is within a prescribed range. A first and second reservoir portions are aligned in a first direction in the horizontal direction. The first reservoir portion is inclined such that a part of the first reservoir portion is situated to progress upward towards the first direction. The second reservoir portion is inclined such that a part of the second reservoir portion is situated to progress upward towards the first direction. The first and second reservoir portions are at least partially overlapped each other in the up-down direction.

10 Claims, 17 Drawing Sheets

PRINT DEVICE

CROSS-REFERENCE TO RELATED APPLICATION

This application claims priority to Japanese Patent Application No. 2014-194246 filed on Sep. 24, 2014, the disclosure of which is herein incorporated by reference in its entirety.

BACKGROUND

The present invention relates to a print device.

There is known a print device that includes a plurality of mount portions each of which mounts a container configured to contain liquid. The print device comprises, for example, a print head, a plurality of main tanks, and a plurality of sub-tanks. The plurality of the sub-tanks are mounted onto the print device. The print head injects an ink. The sub-tanks are reservoir portions which are arranged at flow passages connecting the plurality of the main tanks to the print head, respectively. The ink is supplied from the main tank to the sub-tank, and in turn supplied from the sub-tank to the print head.

SUMMARY

On the nozzle face of the print head which is capable of injecting the ink, a meniscus is formed due to the surface tension of the ink so as to hold the ink. In order not to break the once formed meniscus, it is required to keep the head difference between the nozzle face and the plurality of the sub-tanks within a prescribed range. For this reason, it is conceivable that, for example, the plurality of the sub-tanks are arranged to be aligned in the horizontal direction so as to keep the head difference between the nozzle face and the plurality of the sub-tanks within the prescribed range. However, when the plurality of the sub-tanks are arranged to be aligned in the horizontal direction, then a space in the horizontal direction required for arranging the sub-tanks to be aligned becomes larger, as compared to the case of the sub-tanks being aligned in an up-down direction. For this reason, there is a possibility that the print device would become larger in size.

Various embodiments of the general principles described herein provide a print device that can allow the space in the horizontal direction for arranging a plurality of reservoir portions to become smaller.

Various embodiments of the general principles described herein provide a print device comprising a head portion; a plurality of mount portions; a plurality of flow passages; and a plurality of reservoir portions. The head portion includes a nozzle face. The nozzle face has a nozzle provided to inject liquid. Each of the plurality of the mount portions is configured to mount a container containing the liquid. Each of the plurality of the flow passages connects each of the plurality of the mount portions to the head portion. Each of the plurality of the reservoir portions is configured to reserve the liquid and provided on each of the plurality of the flow passages. Each of the plurality of the reservoir portions is located such that a distance from the nozzle face in the up-down direction is within a prescribed range. A first reservoir portion out of the plurality of the reservoir portions and a second reservoir portion out of the plurality of the reservoir portions are aligned in a first direction in the horizontal direction. The first reservoir portion is inclined such that a part of the first reservoir portion is situated to progress upward towards the first direction. The second reservoir portion is inclined such that a part of the second reservoir portion is situated to progress upward towards the first direction. The first reservoir portion and the second reservoir portion are at least partially overlapped each other in the up-down direction.

BRIEF DESCRIPTION OF THE DRAWINGS

Embodiments will be described below in detail with reference to the accompanying drawings in which.

DESCRIPTION OF EMBODIMENTS

Referring now to FIG. 1 to FIG. 17, a configuration of a printer 1 will be described below. Note that the top side, the bottom side, the lower left side, the upper right side, the lower right side, and the upper left side in FIG. 1 respectively correspond to the top side, the bottom side, the front side, the rear side, the right side, and the left side of the printer 1.

Figure 1:
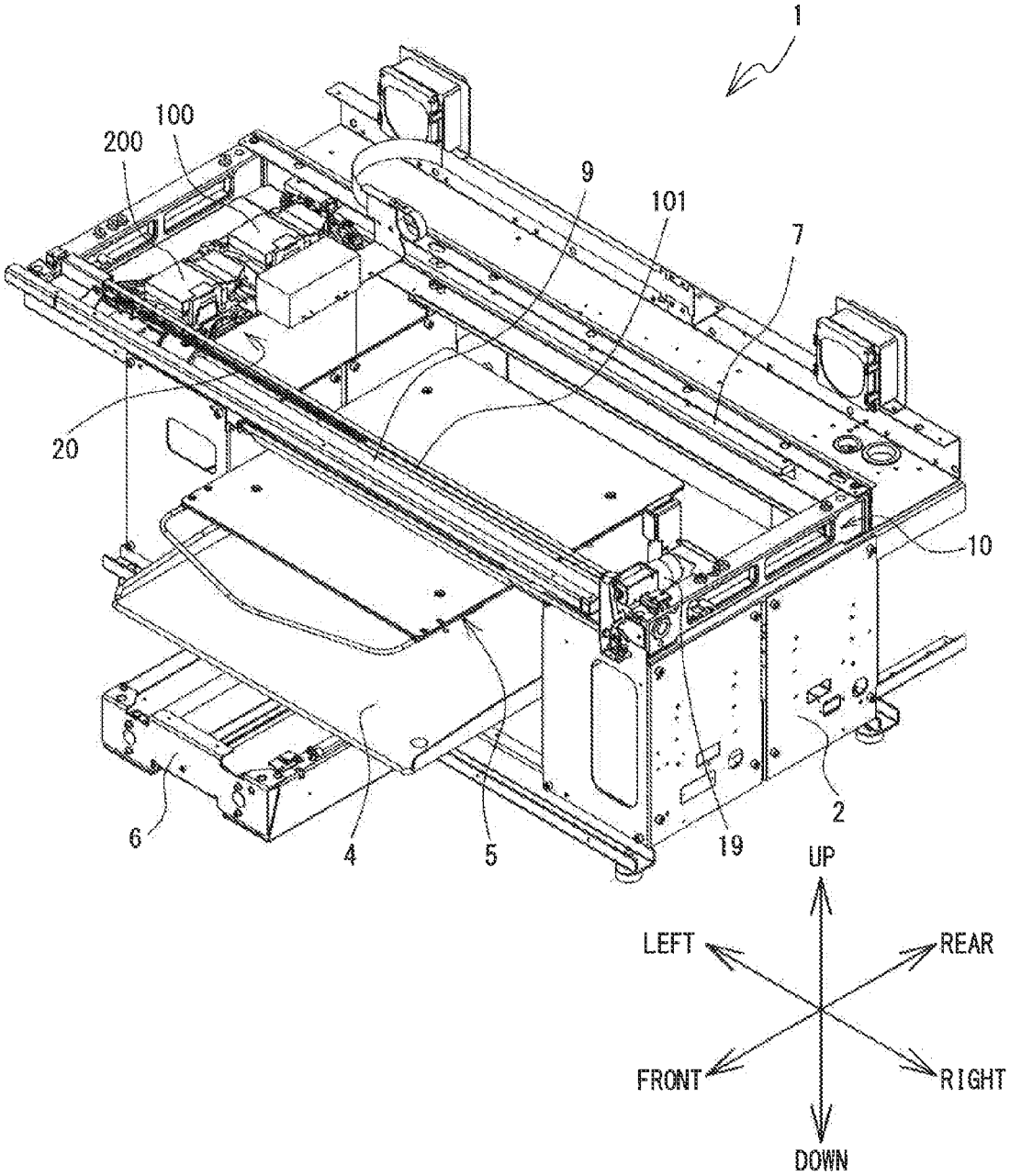
FIG. 1 is a perspective view of a printer.

As shown in FIG. 1, the printer 1 is an inkjet printer, and configured to inject a liquid ink 97 (see FIG. 2) onto a fabric (not shown) such as a T-shirt, which is a printing medium, and print a desired image on the fabric. The printing media may be paper or the like. In this embodiment, the printer 1 injects five different kinds of ink 97 (white, black, yellow, cyan, and magenta) downward to print a color image on the printing medium. In the following description, the while ink 97 among the five kinds of ink 97 (see FIG. 2) may be referred to as a white ink, and the four colors of ink 97, i.e., black, cyan, yellow and magenta, may collectively be referred to as a color ink. The white ink is high precipitationability liquid that contains a component precipitating faster than the color ink. The component that has high precipitationability is, for example, a pigment such as titanium oxide.

For instance, the white ink is injected onto the fabric, and then the color ink are injected subsequent to the injection of the white ink. The white ink is used as, for example, a foundation when printing an image on the fabric that has a dark ground color. It is also possible to use the white ink in a different printing application than injecting the color ink subsequent to injecting the white ink. Specifically, the fabric surface may include an area injected with the white ink only, and an area injected with the color ink only. For a certain image to be printed, the white ink injection may be subsequent to the color ink injection.

The printer 1 includes a housing 2, a platen drive mechanism 6, a pair of guide rails (not shown), a platen 5, a tray 4, a frame body 10, a guide shaft 9, a rail 7, a carriage 20, head units 100 and 200, a drive belt 101, and a drive motor 19.

The housing 2 has a substantially rectangular parallelepiped shape that has the longitudinal direction in the right-left direction. On the right front of the housing 2, there is provided an operation unit (not shown) for operating the printer 1. The operation unit includes a display and operation buttons. The display is configured to display various pieces of information. An operator operates the operation buttons when the operator enters commands and instructions in connection with desired movements, motions and actions of the printer 1.

The frame body 10 has a frame shape, which has a substantially rectangular shape when viewed from the top, and is located on top of the housing 2. The frame body 10 supports the guide shaft 9 at its front side, and supports the rail 7 at its rear side. The guide shaft 9 is a shaft member that has a shaft portion extending in the right-left direction inside the frame body 10. The rail 7 is a rod-shaped member extending in the right-left direction, and located to face the guide shaft 9.

Figure 2:
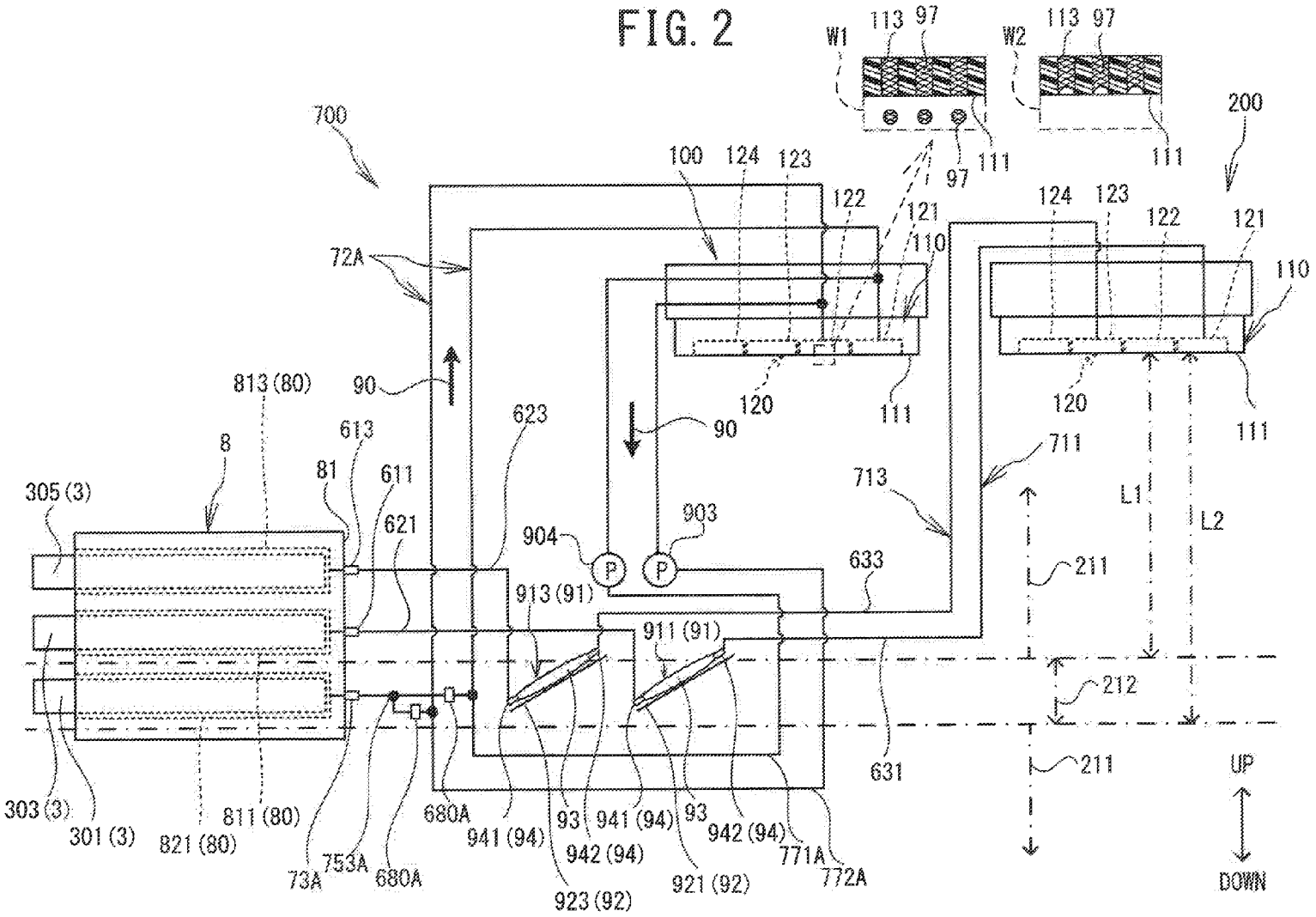
FIG. 2 is a schematic view of part of an ink passage.
Figure 3:
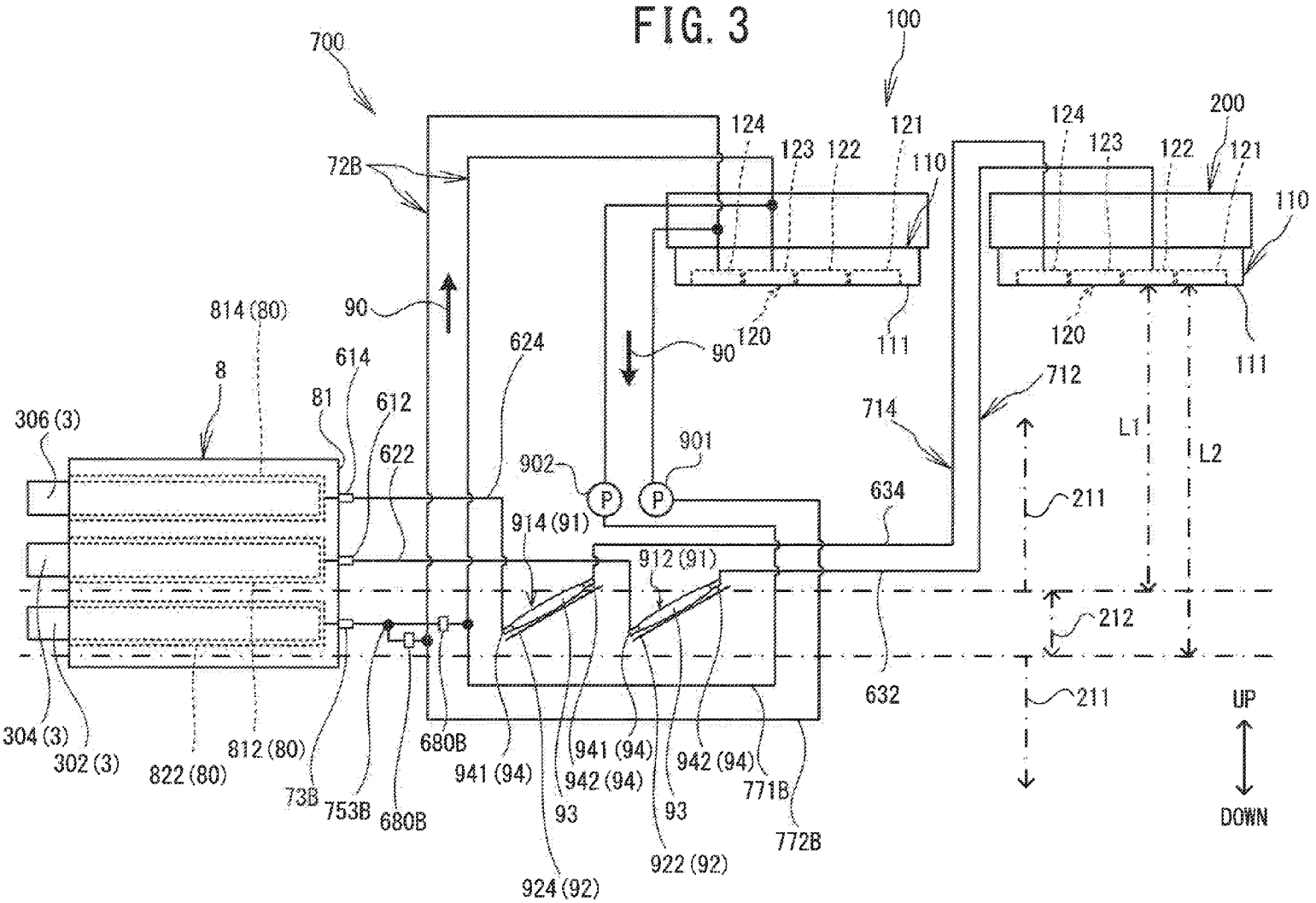
FIG. 3 is a schematic view of another part of the ink passage.

The carriage 20 can move along the guide shaft 9 in the right-left direction. The head units 100 and 200 are arranged in the front-rear direction, and mounted on the carriage 20. The head unit 100 is located behind the head unit 200. As shown in FIG. 2 and FIG. 3, each of the head units 100 and 200 has a head portion 110 at a lower part thereof. FIG. 2 and FIG. 3 schematically illustrate the vertical locations of respective elements and members of the flow passages of the inks 97. As such, FIG. 2 and FIG. 3 depict the head units 100 and 200 side by side in the drawing sheets although the head units 100 and 200 are in fact viewed from the front. The head portion 110 of the head unit 100 injects the white ink. The head portion 110 of the head unit 200 injects the color ink.

The head portion 110 has a nozzle face 111. The nozzle face 111 is a flat surface that is parallel to the horizontal direction, and includes a plurality of fine nozzles 113 (see FIG. 2) configured to inject the inks 97 downward. The nozzle face 111 defines a bottom face of each of the head units 100 and 200. The nozzles 113 are provided in a nozzle arrangement area 120 of the nozzle face 111. The nozzle arrangement area 120 is formed in a center area of the nozzle face 111 in the right-left direction, and extends in the front-rear direction.

The nozzle face 111 has a plurality of nozzle arrays 121-124. Each of the nozzle arrays 121-124 is an array of a plurality of nozzles 113. Each of the nozzle arrays 121-124 is located in corresponding one of four regions defined by dividing the nozzle arrangement area 120 into four parts in the right-left direction. From the right to the left, there are arranged the nozzle array 121, the nozzle array 122, the nozzle array 123 and the nozzle array 124 in this order.

Each of the nozzle arrays 121-124 of the head unit 100 can inject the white ink. The nozzle arrays 121 and 122 of the head unit 100 are coupled to a single cartridge 301 that reserves the white ink (see FIG. 2 and FIG. 4). The nozzle arrays 123 and 124 of the head unit 100 are coupled to another cartridge 302 that reserves the white ink (see FIG. 3 and FIG. 4).

Figure 4:
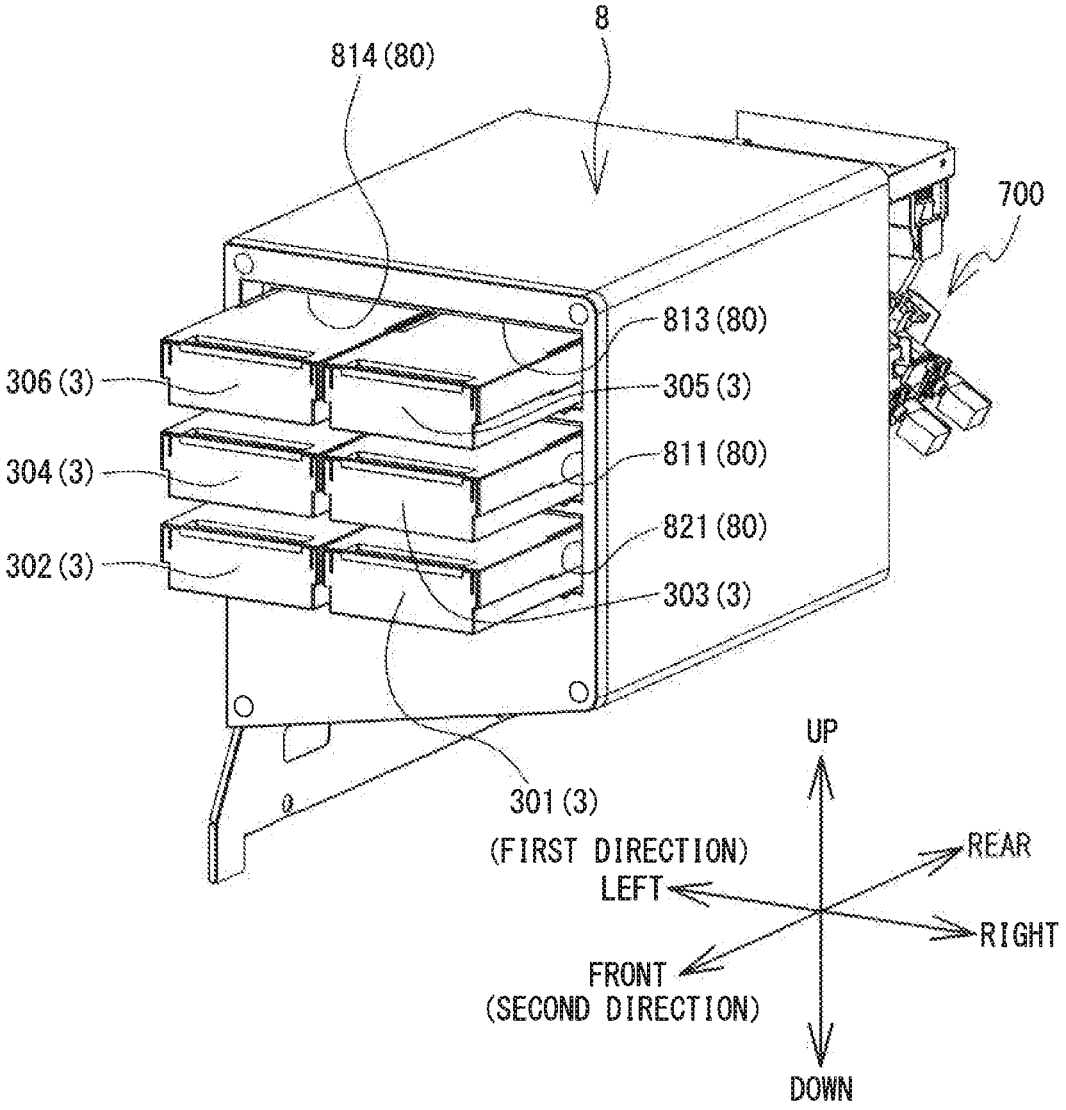
FIG. 4 is a perspective view of a mount frame portion.

As shown in FIG. 2 and FIG. 3, each of the nozzle arrays 121-124 of the head unit 200 is coupled to corresponding one of cartridges 303-306 that retain the color inks. The nozzle array 121 of the head unit 200 is coupled to the cartridge 303 of the magenta ink (see FIG. 2 and FIG. 4), the nozzle array 122 is coupled to the cartridge 304 of the cyan ink (see FIG. 3 and FIG. 4), the nozzle array 123 is coupled to the cartridge 305 of the yellow ink (see FIG. 2 and FIG. 4), and the nozzle array 124 is coupled to the cartridge 306 of the black ink (FIG. 3 and FIG. 4).

As shown in FIG. 1, the drive belt 101 has a strip shape spanning in the right-left direction inside the frame body 10. The drive belt 101 is flexible, and is made from, for example, synthetic resin. The drive motor 19 is provided at the right front area inside the frame body 10, and can rotate in the normal and reverse directions. The drive motor 19 is operatively connected to the carriage 20 via the drive belt 101. As the drive motor 19 drives the drive bel 101, the carriage 20 moves back and forth along the guide shaft 9 in the right-left direction. Accordingly, the head units 100 and 200 move back and forth in the right-left direction, and inject the inks 97 toward the platen 5 that is located below the head units 100 and 200 and faces the head units 100 and 200.

The platen drive mechanism 6 has a pair of guide rails (not shown) and a platen support (not shown). The two guide rails extend in the front-rear direction inside the platen drive mechanism 6, and support the platen support such that the platen support can move in the front-rear direction. The platen support is configured to support the platen 5 at an upper part thereof. The platen 5 supports the printing medium.

The tray 4 is provided below the platen 5. The tray 4 supports sleeves of the T-shirt when the operator puts the T-shirt on the platen 5. Thus, the sleeves of the T-shirt do not contact components other than the tray in the housing 2.

The platen drive mechanism 6 is configured to be driven by a motor (not shown) provided at a rear end of the printer 1. The platen drive mechanism 6 is configured to move the platen support and the platen 5 in the front-rear direction of the housing 2 along the paired guide rails. As the platen 5 transports the printing medium in the front-rear direction (sub-scanning direction) and the head portion 110 injects the inks 97 while moving in the right-left direction in the reciprocal manner, the printer 1 prints on the printing medium.

A mount frame portion 8 shown in FIG. 4 is provided on the right side of the printer 1. The mount frame portion 8 is supported by the housing 2 (not shown in FIG. 4). The mount frame portion 8 has a plurality of mount portions 80, and each of the mount portions 80 is configured to mount the cartridge 3. Each mount portion 80 is a recess that has a rectangular parallelepiped shape, and is concave in the rear direction from the front face of the mount frame portion 8. The inner rear end of each mount portion 80 has a hollow needle (not shown) extending toward the front. As the cartridge 3 is mounted in the mount portion 80, the hollow needle sticks in a rubber lid (not shown) provided at a mouth plug 70 (see FIG. 5) of a liquid container 31 received in the cartridge 3. The hollow needle draws out the ink 97 from the liquid container 31 (see FIG. 5) held in the cartridge 3.

Figure 5:
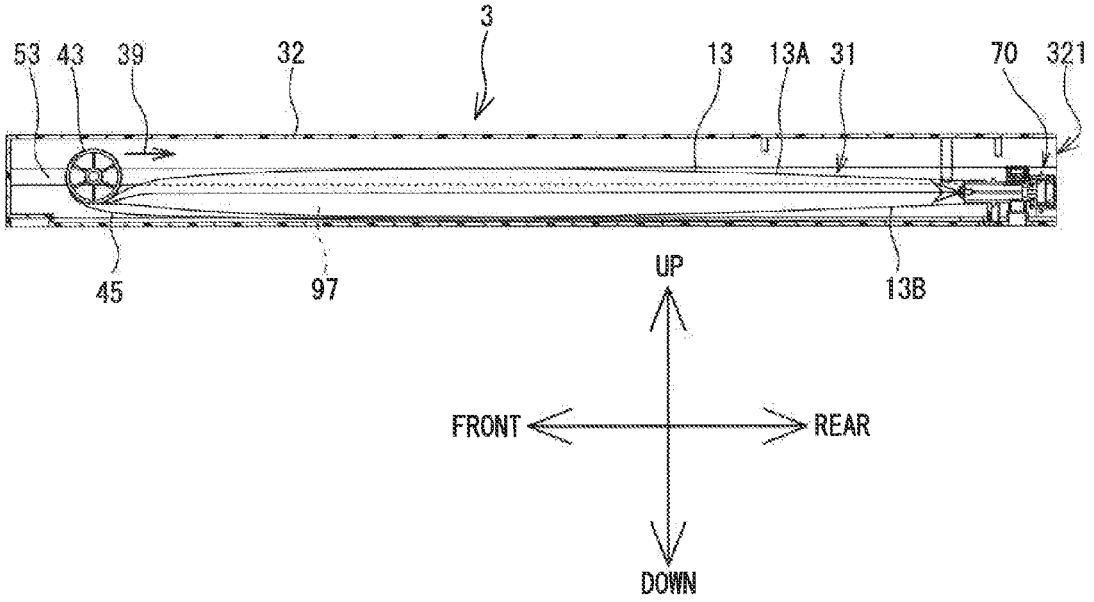
FIG. 5 is a vertical cross-sectional view of a cartridge.

As shown in FIG. 5, the cartridge 3 has a casing 32, the liquid container 31, a shaft 43, and a resilient member 45. The casing 32 is a rectangular parallelepiped, which is generally elongated in the front-rear direction. The casing 32 has an opening 321 at its rear end. The liquid container 31 is located in the casing 32. The liquid container 31 has a liquid bag 13 and the mouth plug 70. The liquid bag 13 is a bag-like container formed by placing rectangular flexible films 13A and 13B one after another, which are made from synthetic resin or the like, such that one face of one of the films faces one face of the other film, and heating and fusing the peripheries of the two films (by means of thermal seal) to connect the two films 13A and 13B to each other. The liquid bag 13 extends in the front-rear direction. The mouth plug 70 is attached to the rear end of the liquid bag 13, and is exposed rearward from the opening 321 of the casing 32. The mouth plug 70 is a cylindrical element extending in the rear direction, and a rubber plug (not shown) disposed in the mouth plug 70 provides a seal such that the ink 97 in the liquid bag 13 does not leak.

The shaft 43 has a cylindrical shape extending in the right-left direction. The shaft 43 has projections (not shown) at right and left ends thereof such that the projections project outwardly in the right and left directions respectively. The projections are located in recesses 53 provided at right and left side faces in the casing 32. The recesses 53 are depressed outwardly in the right and left directions, respectively, and extend in the front-rear direction. The resilient member 45 extend on the bottom face in the front-rear direction inside the casing 32. A rear end of the resilient member 45 is secured to a rear part of the casing 32, and a front end of the resilient member 45 is wound around the shaft 43 such that the resilient member 45 biases the shaft 43 and exerts a returning force in the rear direction. Thus, the shaft 43 winds up the liquid bag 13 and collects the ink 97 toward the mouth plug 70 as the shaft 43 moves in the rear direction. In other words, the shaft 43 moves in the rear direction as the remaining amount of ink 97 in the liquid container 31 decreases (see the arrow 39 in FIG. 5).

The ink 97 is supplied to the nozzle face 111 from the cartridge 3 engaged in the mount portion 80. As shown in FIG. 2 and FIG. 3, a region in the up-down direction is referred to as a first region 211. The first region 211 is a region in which a distance from the nozzle face 111 in the up-down direction is out of a predetermined range. Also, a region in the up-down direction is referred to as a second region 212. The second region 212 is a region in which a distance from the nozzle face 111 in the up-down direction is in the predetermined range. In this embodiment, the predetermined range is a range in which a distance measured from the nozzle face 111 in the downward direction falls within a range between the distances L1 and L2. For example, L1 is 10 mm and L2 is 50 mm. As shown in the enlarged view W2 in FIG. 2, a meniscus is created at the nozzle face 111 by the surface tension, i.e., the ink 97 is concave in the nozzle 113. The meniscus holds the ink 97 at the nozzle face 111. When the ink 97 is supplied toward the nozzle face 111 from the second region 212, which is the predetermined range apart from the nozzle face 111 by the predetermined distance in the up-down direction, the meniscus is difficult to break, and it is possible to properly inject the ink 97.

Figure 6:
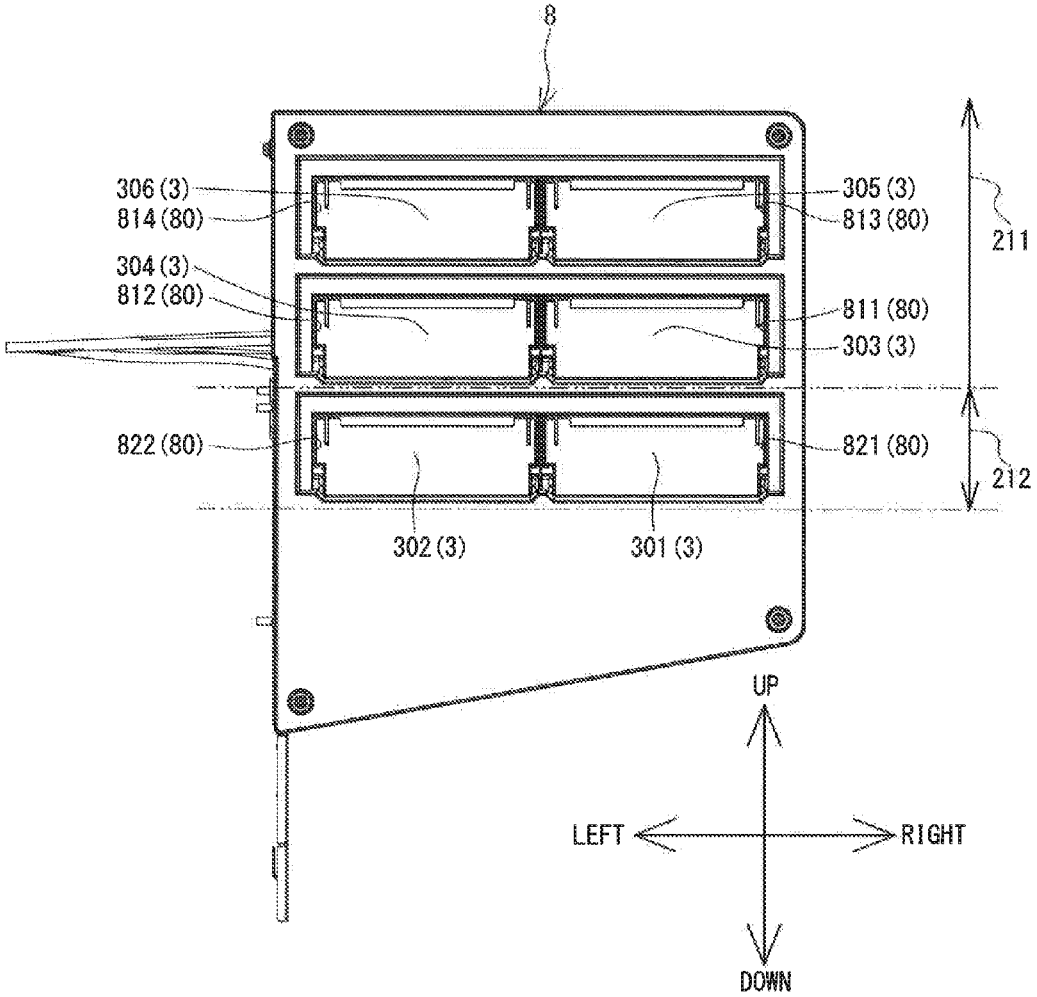
FIG. 6 is a front view of the mount frame portion.

As shown in FIG. 4 and FIG. 6, the mount portions 80 are arranged in two columns side by side in the right-left direction and in three tiers in the up-down direction. As shown in FIG. 2, FIG. 3 and FIG. 6, the mount portions 80 includes first mount portions 811-814 located in the first region 211, and second mount portions 821 and 822 located in the second region 212. In this embodiment, the second mount portions 821 and 822 are located below the first mount portions 811-814. Specifically, as shown in FIG. 6, the second mount portion 821 is located at the lower right area of the mount frame portion 8, and the second mount portion 822 is located on the left of the second mount portion 821. The first mount portions 811 and 812 are located above the second mount portions 821 and 822, respectively, and the first mount portions 813 and 814 are located above the first mount portions 811 and 812, respectively. In addition, the first mount portions 811 and 813 are located such that the first mount portions 811 and 813 are aligned in the up-down direction at the upper side of the plurality of the sub-tanks 91. Likewise, the first mount portions 812 and 814 are arranged such that the first mount portions 812 and 814 are located in the up-down direction at the upper side of the sub-tanks 91.

The second mount portions 821 and 822 can mount the cartridges 301 and 302, respectively. Each of the cartridges 301 and 302 contains the white ink. The first mount portions 811 to 814 can mount the cartridges 303 to 306, respectively. The cartridges 303-306 contain the color inks.

Figure 7:
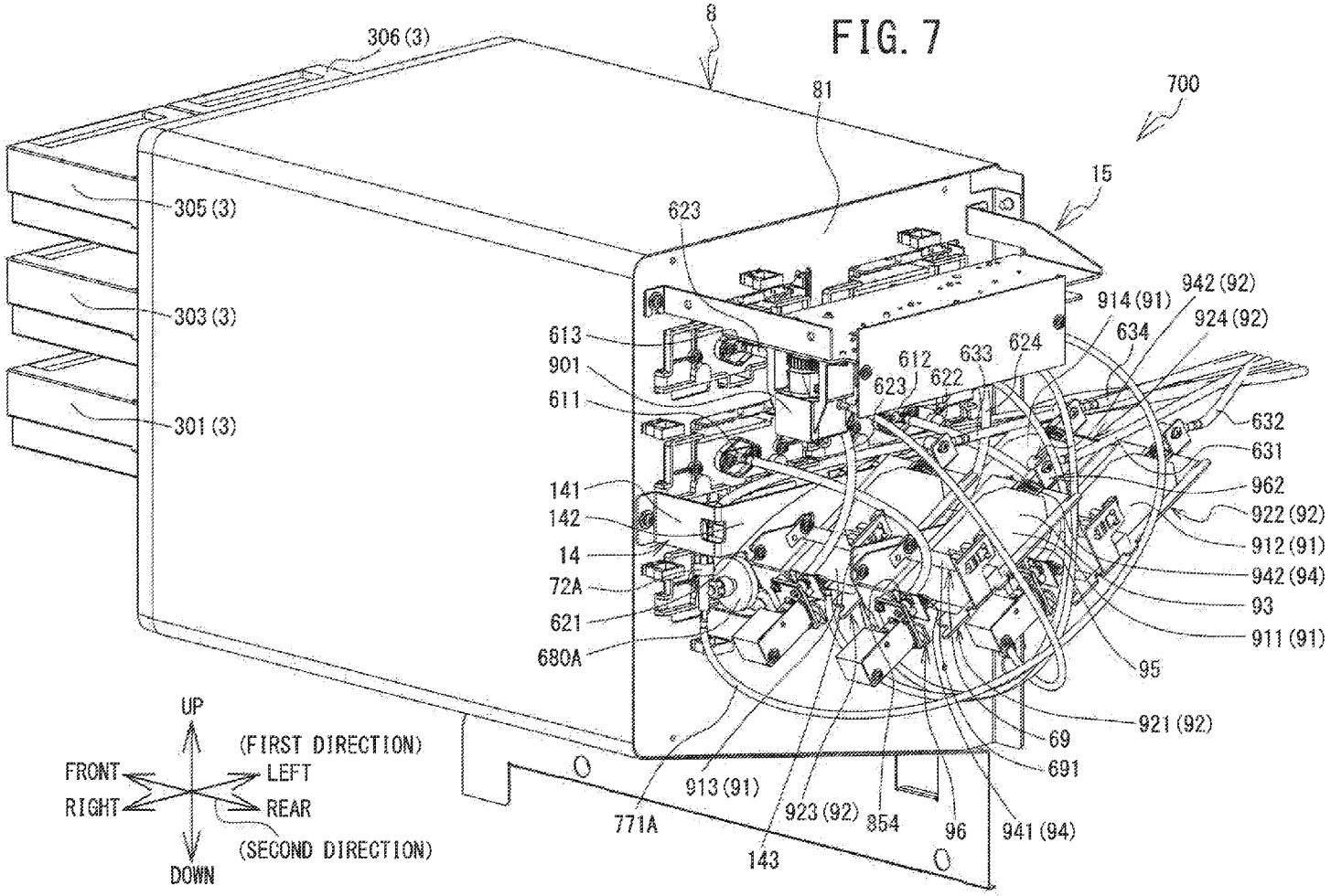
FIG. 7 is a perspective view of the mount frame portion and the ink passage.
Figure 8:
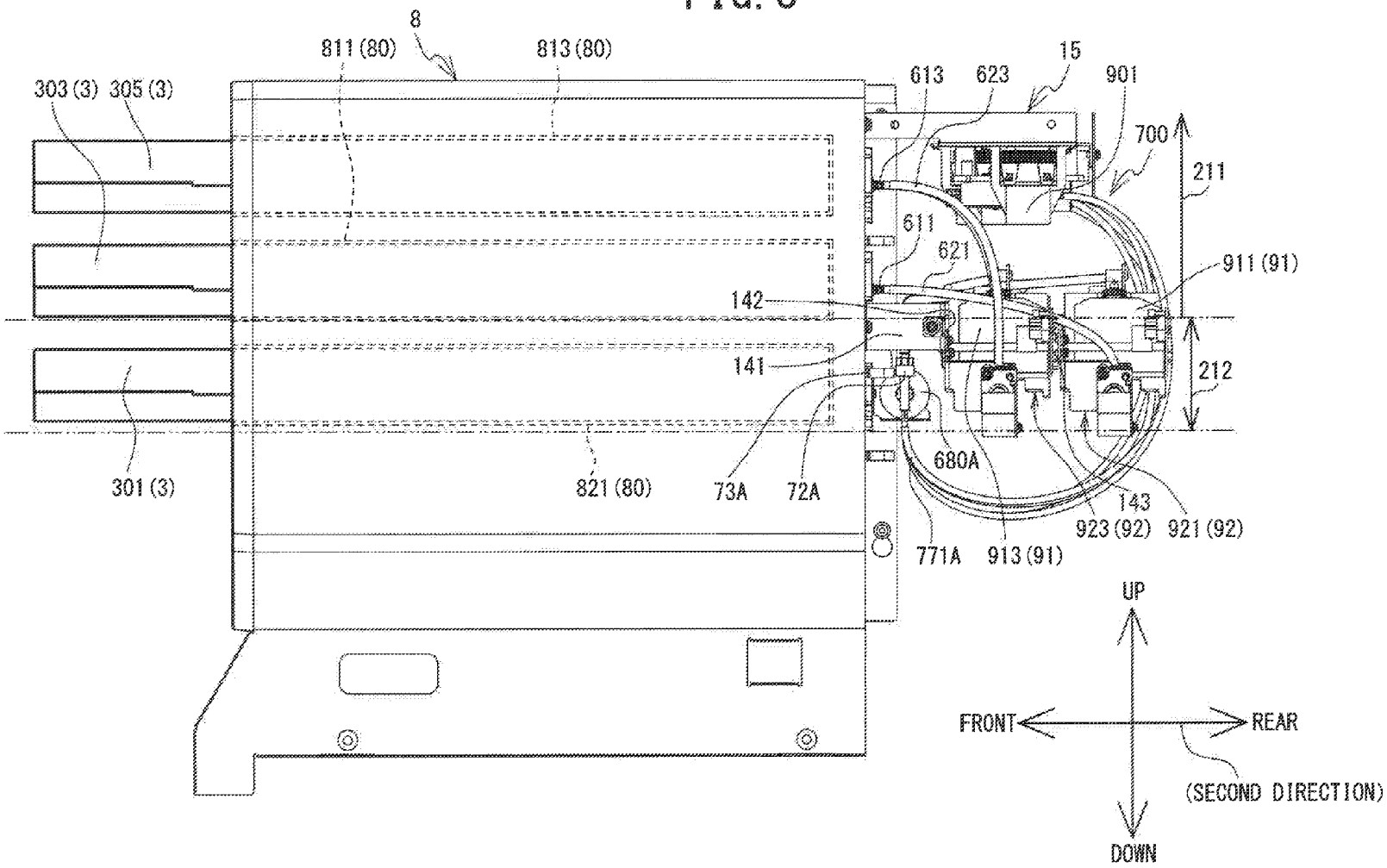
FIG. 8 is a right side view of the mount frame portion and the ink passage.

As shown in FIG. 7 and FIG. 8, four sub-tanks 91 and four sub-tank supports 92 are provided behind the mount frame portion 8. The sub-tanks 91 and the sub-tank supports 92 are located such that they face the second mount portions 821 and 822 in the horizontal direction. As shown in FIG. 2, FIG. 3 and FIG. 8, the sub-tanks 91 are located in the second region 212. FIG. 2 and FIG. 3 schematically show the positions of the respective members of the flow passage of the ink 97 in the up-down direction. The directions of the sub-tank(s) 91 and the sub-tank support(s) 92 may be different from the directions shown in FIG. 7. The sub-tanks 91 define reservoir passages 711-714, which will be described later (see FIG. 2 and FIG. 3), and can reserve the ink 97 to be supplied to the nozzle face 111 from the cartridge 3.

Hereinafter, the configuration of the sub-tank 91 will be described below. In the following description, the top side, the bottom side, the upper left side, the lower right side, the lower left side, and the upper right side in FIG. 9 respectively correspond to the top side, the bottom side, the front side, the rear side, the right side, and the left side of the sub-tank 91. Moreover, as shown in FIG. 7, in the state that the sub-tank 91 and the sub-tank support 92 are mounted onto the printer 1, the left direction in the horizontal direction may be referred to as a "first direction", and likewise the front-rear direction orthogonal to the first direction in the horizontal direction may be referred to as a "second direction".

Figure 9:
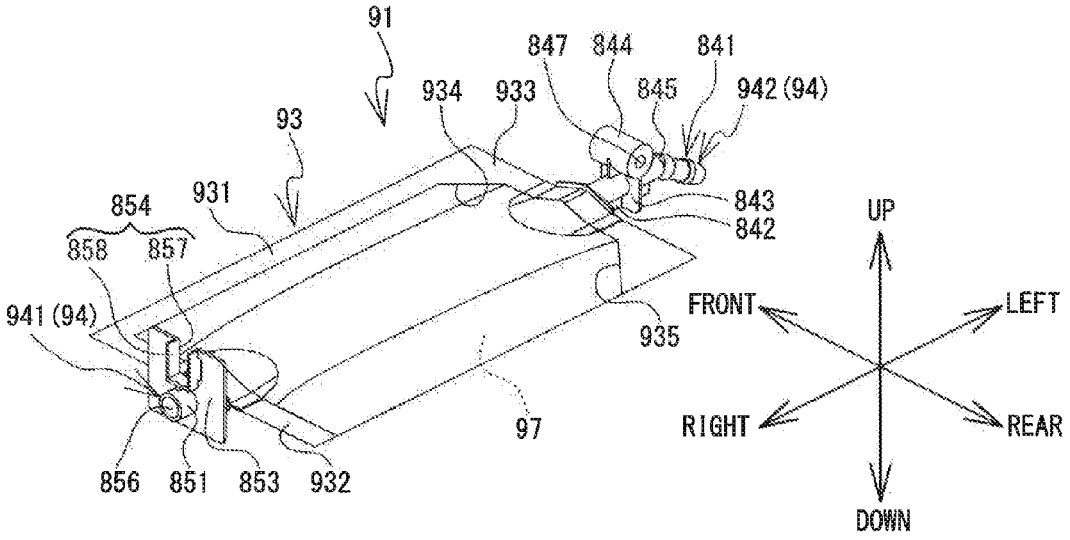
FIG. 9 is a perspective view of a sub-tank.
Figure 10:
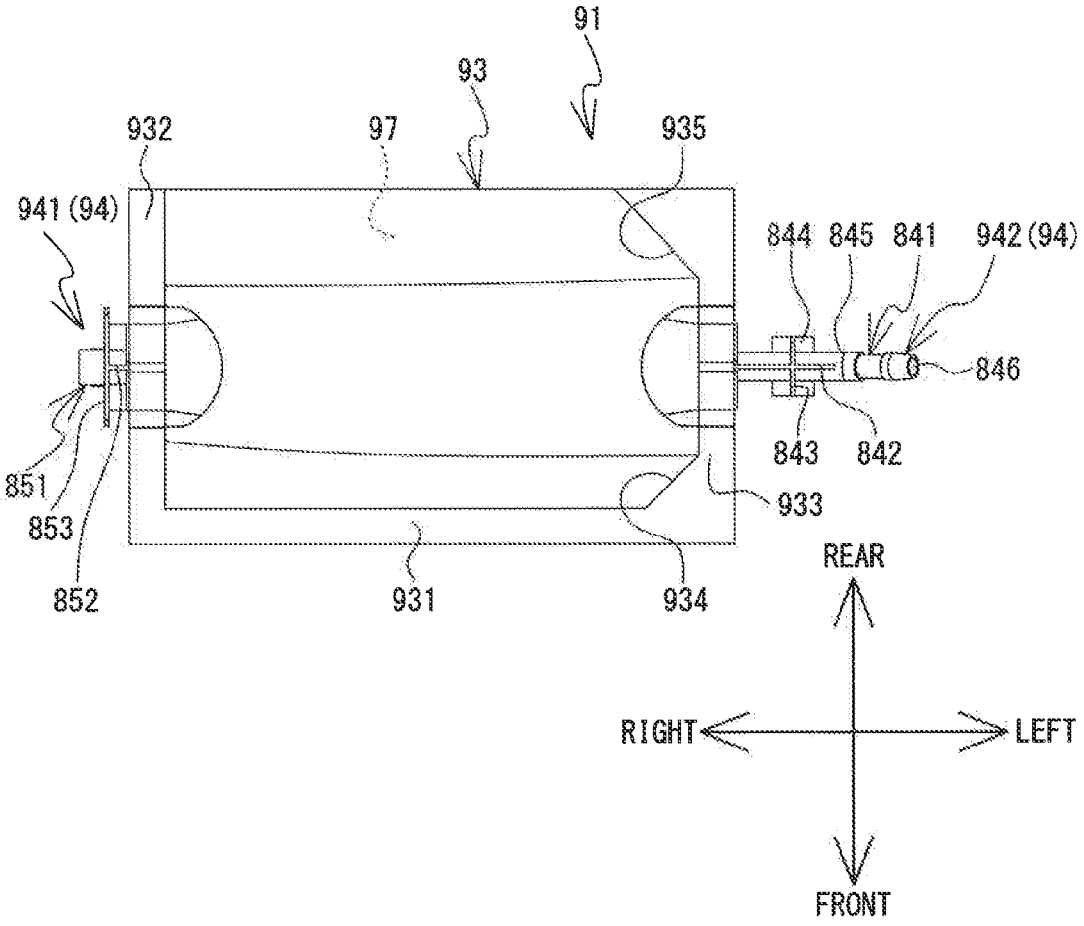
FIG. 10 is a bottom view of the sub-tank.
Figure 11:
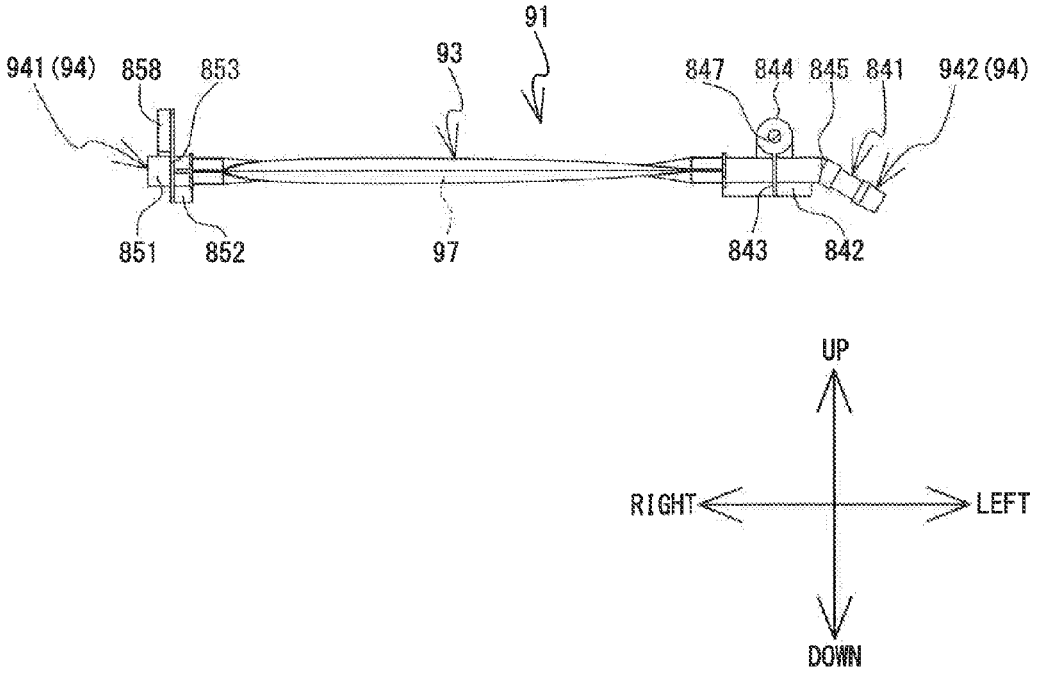
FIG. 11 is a rear view of the sub-tank.

As shown in FIG. 9 to FIG. 11, the sub-tank 91 is provided with a bag portion 93 and a mouth plug 94. The bag portion 93 is capable of internally containing the liquid ink 97. The bag portion 93 has the rectangular shape, when viewed from the top, with the right-left direction being the longitudinal direction. As shown in FIG. 7, the bag portion 93 is inclined such that a part of the bag portion 93 is situated to progress upward towards the first direction. It should be noted that, in FIG. 7, the reference numerals of the bag portion 93 and the mouth plug 94 are shown only with respect to the sub-tank 911, which will be described later.

The mouth plug 94 includes an flow inlet 941 and an flow outlet 942. As shown in FIG. 7 and FIG. 9, the flow inlet 941 is provided at an end part of the right direction side, which is opposite to the first direction (see, FIG. 7) in the bag portion 93. The flow inlet 941 can allow the ink 97 to flow into the bag portion 93. The flow outlet 942 is provided at an end part in the first direction in the bag portion 93. The flow outlet 942 can allow the ink 97 to flow out of the bag portion 93. As shown in FIG. 7, in the up-down direction, the flow outlet 942 is situated on the upper side of the flow inlet 941.

As shown in FIG. 9 to FIG. 11, each of the bag portions 93 is a container that is formed by folding a single sheet of flexible synthetic resin film having a rectangular shape, and joining the peripheral parts of the sheet to each other by heating and fusing (thermal seal). As shown in FIG. 9 and FIG. 10, in the bag portion 93, a front part of the bag portion 93 to which end parts facing each other of the single sheet of film is joined is referred to as a "first junction portion 931". The first junction portion 931 extends in the left direction from the flow inlet 941 towards the flow outlet 942. As such, a right part of the bag portion 93 to which parts facing each other of the single sheet of film are joined is referred to as a "second junction portion 932". Likewise, a left part of the bag portion 93 to which parts facing each other of the single sheet of film are joined is referred to as a "third junction portion 933". The second junction portion 932 and the third junction portion 933 extend in the front and rear direction, respectively.

At the end part at the flow outlet 942 side of the bag portion 93, tapered portions 934 and 935 are provided. The tapered portions 934 and 935 are formed at the right end of the third junction portion 933. The tapered portions 934 and 935 are inclined such that the width of a space inside the bag portion 93 becomes smaller towards the flow outlet 942 from the flow inlet 941. More particularly, the flow outlet 942 is located in the center part in the front-rear direction of the bag portion 93. The tapered portion 934 is formed such that the tapered portion 934 is inclined to the diagonally backward left direction from the left end part of the first junction portion 931. Likewise, the tapered portion 935 is formed such that the tapered portion 935 is inclined to the diagonally front left direction from the left part of the rear part of the bag portion 93.

As shown in FIG. 9 to FIG. 11, the flow outlet 942 includes a cylindrical portion 841, a first plate portion 842, a second plate portion 843 and a month plug fixation portion 844. A right part of the cylindrical portion 841 is inserted into inside the bag portion 93 through between the films facing each other at the third junction portion 933 of the bag portion 93. The cylindrical portion 841 extends in the left direction, and bends to the downward left direction at the bending portion 845. The ink 97 flows inside a hole portion 846 (see FIG. 10), which is formed inside the cylindrical portion 841. The first plate portion 842 protrudes downward from a right part of the bending portion 845 of the cylindrical portion 841. The first plate portion 842 extends in the right-left direction.

The second plate portion 843 extends in the up-down direction and in the front-rear direction from a part of the bending portion 845 which is present on the right of the cylindrical portion 841. In the up-down direction, a lower end of the second plate portion 843 is situated at the same position as a lower end of the first plate portion 842. The first plate portion 842 and the second plate portion 843 orthogonally intersect each other, when viewed from the bottom (see FIG. 10). The lower ends of the first plate portion 842 and the second plate portion 843 serve as a support portion configured to support the flow outlet 942, when the sub-tank 91 is mounted onto the sub-tank support portion 92. A month plug fixation portion 844, which extends in the front-rear direction and has a cylindrical shape, is connected to an upper end of the second plate portion 843. A screw hole 847, which extends in the front and read direction, is formed at a rear part of the month plug fixation portion 844 (see FIG. 9)

The flow inlet 941 includes a cylinder portion 851, a first plate portion 852 (see FIG. 10 and FIG. 11), a second plate portion 853 and an engagement portion 854. The left part of the cylinder portion 851 is inserted into inside of the bag portion 93 through between the films facing each other at the second junction portion 932 of the bag portion 93. The cylinder portion 851 extends in the right direction. The ink 97 flows inside a hole portion 856 (see FIG. 9) formed inside the cylinder portion 851. The first plate portion 852 (see FIG. 10 and FIG. 11) protrudes downward from the cylinder portion 851. The first plate portion 852 extends in the left direction from the center part in the left and right direction of the cylinder portion 851.

The second plate portion 853 extends in the up-down direction and in the front-rear direction from the center part of the cylinder portion 851 in the right-left direction. In the up-down direction, the lower end of the second plate portion 853 is situated at the same position as the lower end of the first plate portion 852. The second plate portion 853 is connected to the right end of the first plate portion 852 (see FIG. 10).

As shown in FIG. 9, a recess portion 857 is provided in the center part in the front-rear direction at an upper end of the second plate portion 853. The recess portion 857 is recessed downward in a rectangular shape. A wall portion 858 protrudes in the right direction along the recess portion 857. The engagement portion 854 is formed with the recess portion 857 and the wall portion 858. The engagement portion 854 is a portion configured to engage with an outer faces of either of the first connection flow passages 621 to 624 (see FIG. 7 and FIG. 12).

Figure 12:
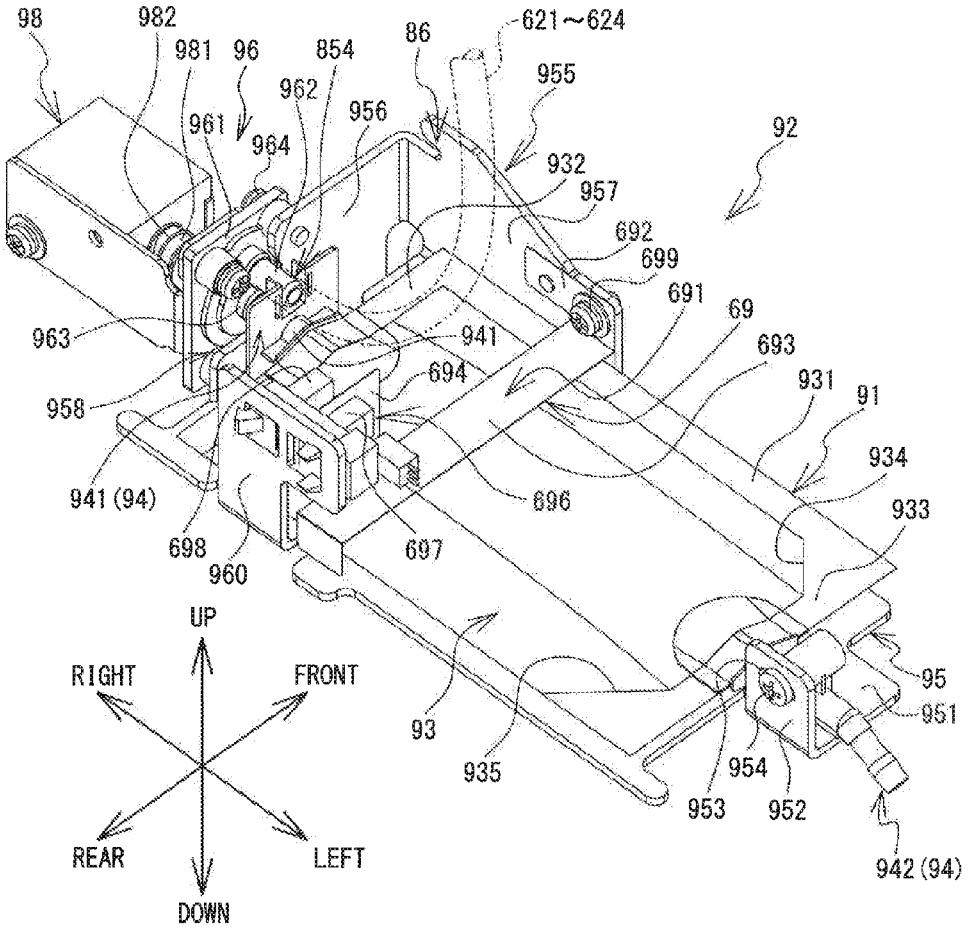
FIG. 12 is a perspective view of a sub-tank support portion which is supporting the sub-tank.

Hereinafter, the configuration of the sub-tank support portion 92 will be described below in detail. In the following description, the top side, the bottom side, the upper right side, the lower left side, the upper left side, and the lower right side in FIG. 12 respectively correspond to the top side, the bottom side, the front side, the rear side, the right side, and the left side of the sub-tank support portion 92. The sub-tank support portion 92 is configured to support the sub-tank 91. As shown in FIG. 7 and FIG. 12, the sub-tank support portion 92 includes a support plate portion 95, a valve portion 96 and a detection portion 69. It should be noted that the reference numerals denoting the support plate portion 95, the valve portion 96, and the detection portion 69 are shown only for the sub-tank support portion 921.

As shown in FIG. 12, the support plate portion 95 is a plate-like shaped member and supports the sub-tank 91 on the upper face side thereof. A protrusion portion 951 protruding in the left direction is provided in the center part in the front-rear direction at the left end part of the support plate portion 95. The upper face of the protrusion portion 951 contacts the first plate portion 842 and the second plate portion 843 (see FIG. 10) which form the lower end of the flow outlet 942, and supports the flow outlet 942. A wall portion 952 extending upward is provided at the rear end part of the protrusion portion 951. The wall portion 952 has a hole 953 that penetrates in the front-rear direction. A head part of the screw 954 is located at the rear side of the hole 953, and a shaft part of the screw 954 is inserted into the hole 953. The shaft part of the screw 954 is fastened to the screw hole 847 (see FIG. 11) of the flow outlet 942. With this configuration, the flow outlet 942 is secured to the sub-tank support portion 92.

A wall portion 955 is erected upward at the right front part of the support plate portion 95. The wall portion 955 has a first wall portion 956 extending in the front-rear direction along the right end of the support plate portion 95 and a second wall portion 957 extending in the right-left direction along the front end of the support plate portion 95. The rear end of the first wall portion 956 is situated at the front side with respect to the read end of the support plate portion 95. A cutout portion 958, which is cutout downward in the first wall portion 956, is formed at the rear part of the first wall portion 956.

The upper end of the second wall portion 957 is inclined such that the upper end of the second wall portion 957 is situated to progress lower towards the left side direction. At the upper right end part of the second wall portion 957, a first fixation portion 86 is provided. The first fixation portion 86 is formed with the right end of the second wall portion 957 being recessed. The first fixation portion 86 is a portion configured to secure the sub-tank support portion 92 to the support plate portion 14 (see FIG. 7) which is the other member of the sub-tank support portion 92.

The valve portion 96 is located at the right side of the support plate portion 95. The valve portion 96 is provided at each of reservoir passages 711 to 714 (see, FIG. 2 and FIG. 3), which will be described later, and opens and closes the reservoir passages 711 to 714. More particularly, each of the valve portions 96 is connected to corresponding one of first connection flow passages 621 to 624, which will be described later, and corresponding one of the flow inlet 941 to open and close the flow passage between the corresponding one of the first connection flow passages 621 to 624 and the corresponding one of the flow inlet 941.

The valve portion 96 includes a flow passage formation portion 961, a first connection port member 962, a second connection port member 963 and a solenoid 98. The flow passage formation portion 961 has a rectangular shape, when viewed from the left side. The upper front part and the lower rear part of the flow passage formation portion 961 are coupled to the circumferential parts of the cutout portion 958 in the first wall portion 956, respectively, with the screws 964 and 965 (see FIG. 13). With this configuration, the valve portion 96 is supported by the wall portion 955.

The first connection port member 962 has a cylindrical shape which protrudes in the left direction from the left face of the flow passage formation portion 961. The left end part of the first connection port member 962 is located inside the engagement portion 854 which is provided at the flow inlet 941. The first connection port member 962 is connected to the first connection flow passages 621 to 624, respectively. At this moment, the engagement portion 854 engages with the outer face of the first connection flow passages 621 to 624 (see FIG. 7 and FIG. 12).

Figure 13:
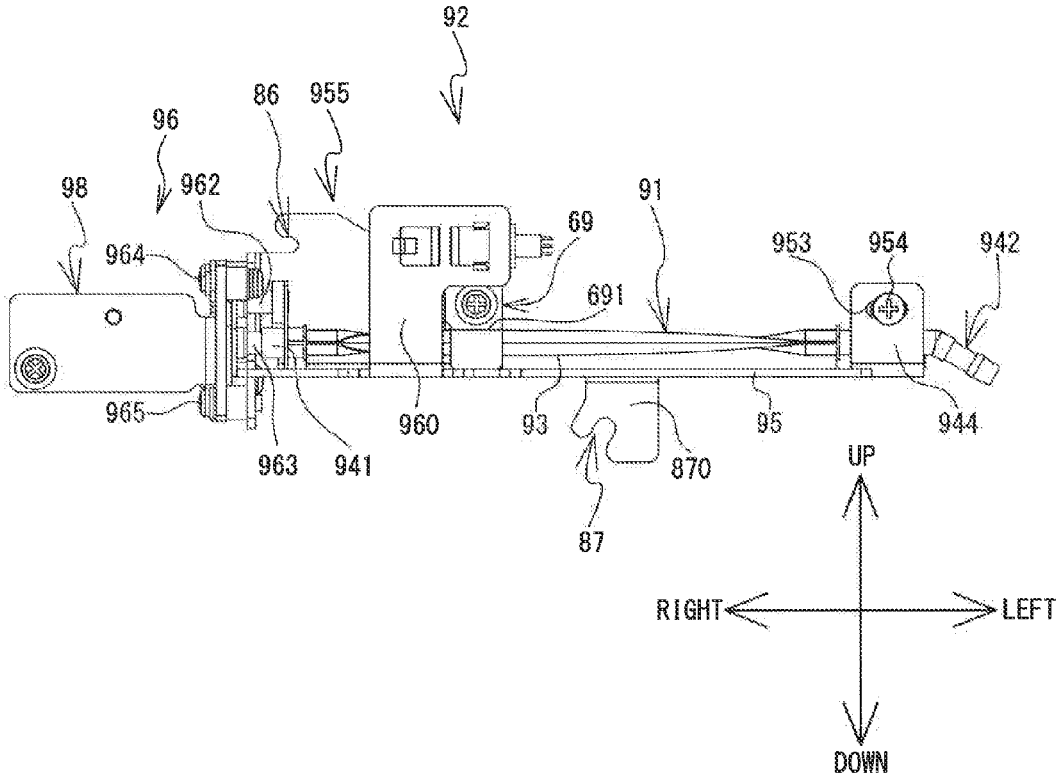
FIG. 13 is a rear view of the sub-tank support portion which is supporting the sub-tank.
Figure 14:
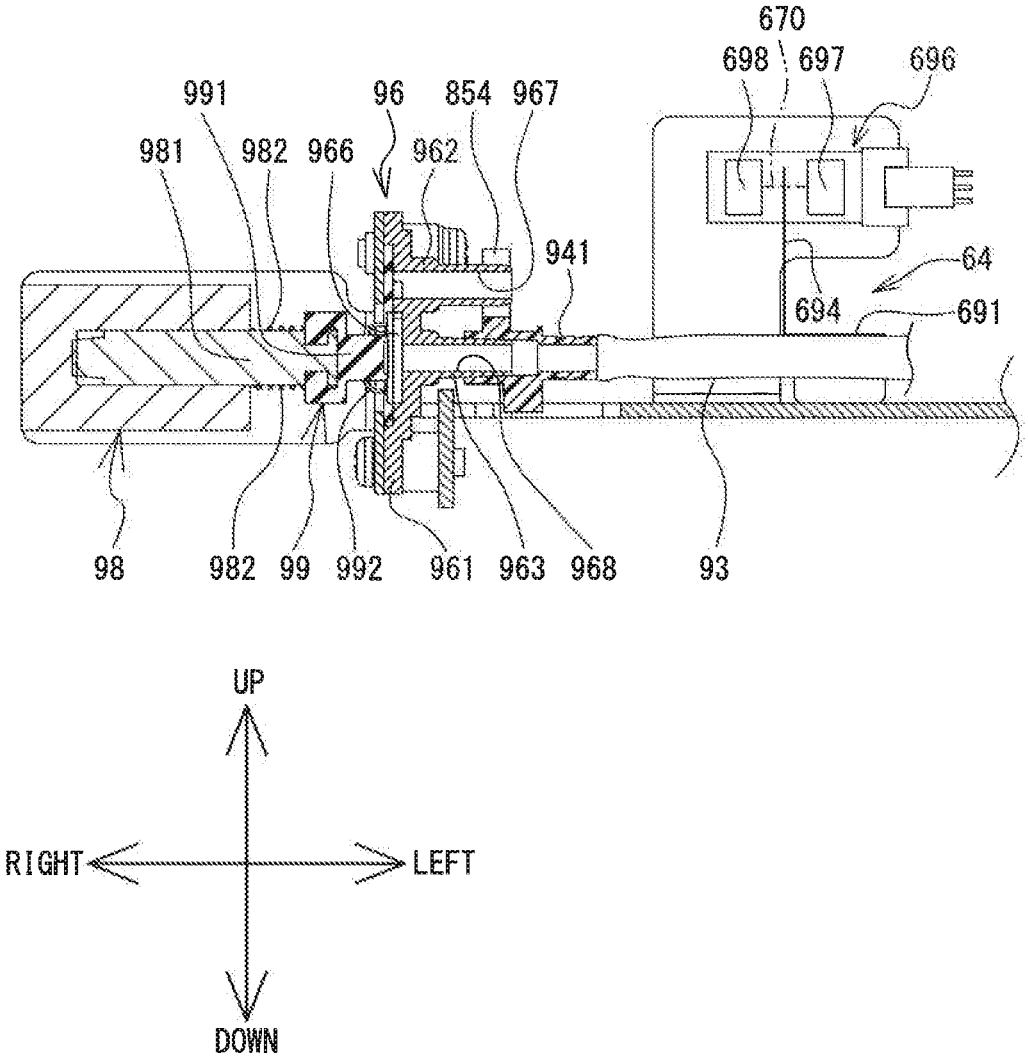
FIG. 14 is an enlarged vertical cross section view of a main part of the sub-tank support portion which is supporting the sub-tank.

As shown in FIG. 12 to FIG. 14, the second connection port member 963 is located at lower side of the first connection port member 962. The second connection port member 963 has a cylindrical shape protruding in the left direction from the left face of the flow passage formation portion 961. The second connection port member 963 is connected to the flow inlet 941. As shown in FIG. 14, at the right part of the flow passage formation portion 961, a flow passage 966 is formed which connect a flow passage 967 in the first connection port member 962 to a flow passage 968 in the second connection port member 963.

As shown in FIG. 12 and FIG. 14, the solenoid 98 is located at the right side of the valve portion 96. The solenoid 98 includes a movable shaft 981 extending in the left direction. A coil spring 982 is located in the vicinity of the movable shaft 981. The solenoid 98, under the control of a CPU (not shown), is switched to the energizing state to allow the movable shaft 981 to move in the right direction against the biasing force of the coil spring 982. On the other hand, the solenoid 98, under the control of the CPU, is switched to the non-energizing state to allow the movable shaft 981 to move in the left direction by the biasing force of the coil spring 982.

As shown in FIG. 14, an open-close member 99 is coupled to the front edge part of the movable shaft 981. The open-close member 99 includes an open-close shaft 991 and a covering portion 992. The open-close shaft 991 is provided at the left end part of the open-close member 99, and has a cylindrical shape extending in the left direction. The open-close shaft 991 is located at the right side of the second connection port member 963. The diameter of the open-close shaft 991 is larger than the diameter of the flow passage 968 of the second connection port member 963. When the movable shaft 981 moves in the left direction, the open-close shaft 991 closes the flow passage 968 of the second connection port member 963. Thus, the flow passage 966 is closed and the ink 97 is barred from flowing. On the other hand, when the movable shaft 981 moves in the right direction, the open-close shaft 991 opens the flow passage 968 of the second connection port member 963. Thus, the flow passage 966 is opened and the ink 97 starts to flow.

The covering portion 992 extends outwardly in the radial direction from somewhat right side of the left end of the open-close shaft 991, and is connected to the circumferential part of the flow passage 966 of the flow passage formation portion 961. In other words, the covering portion 992 covers the flow passage formation portion 961. The covering portion 992 has the resilient property and warp in following the movement of the movable shaft 981 in the right-left direction.

As shown in FIG. 12, a wall portion 960 is erected upwardly at the right part of the rear end part of the support plate portion 95. The detection portion 69 includes a remaining amount detection plate 691 and an optical detection portion 696. The optical detection portion 696 is located at the front face of the wall portion 960. The optical detection portion 696 includes a light emitting portion 697 and a light receiving portion 698. The light emitting portion 697 and the light receiving portion 698 are distant each other in the right-left direction. The optical detection portion 696 is electrically connected, through a detection circuit (not shown), to the CPU (not shown).

Figure 15:
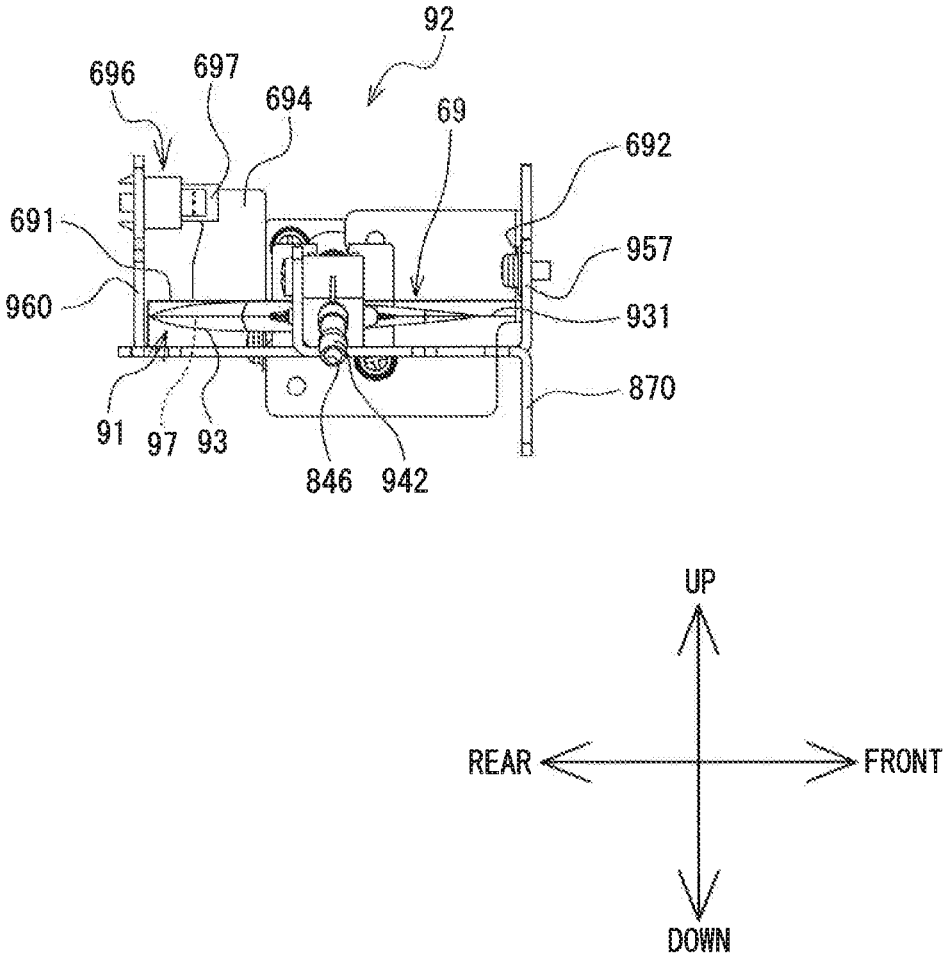
FIG. 15 is a left side view of the sub-tank support portion which is supporting the sub-tank.
Figure 16:
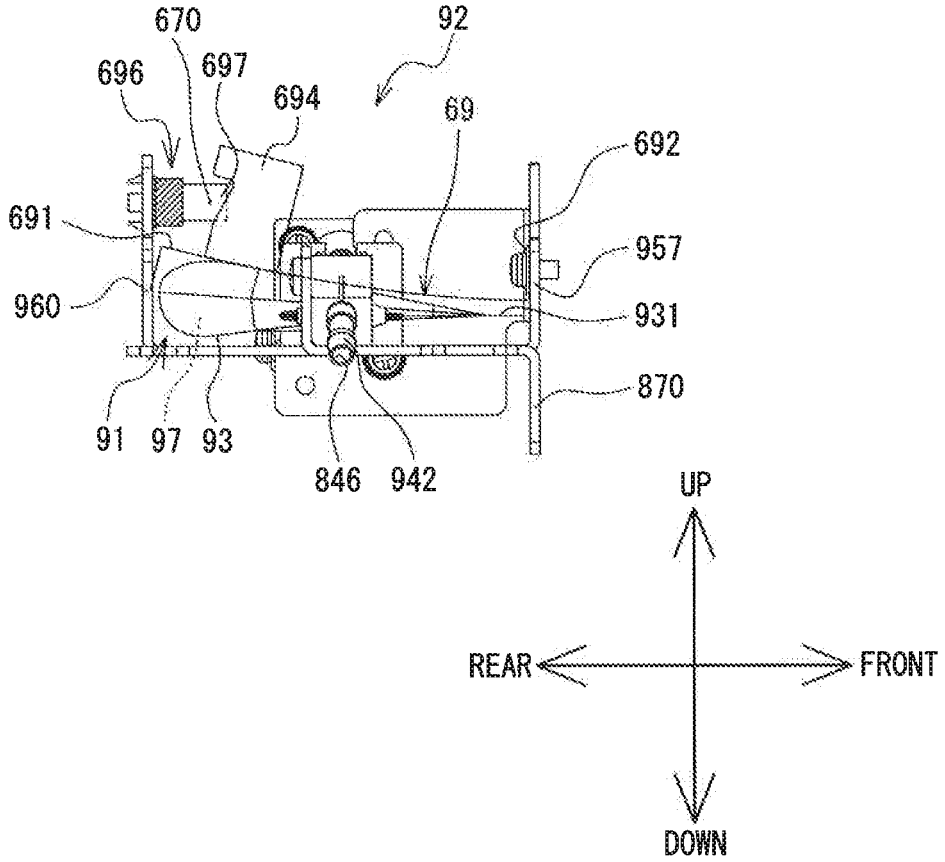
FIG. 16 is a left side view of the sub-tank support portion which is supporting the sub-tank, which shows a state that the thickness of a bag portion of the sub-tank becomes thicker from the state shown in FIG. 15.

The remaining amount detection plate 691 is capable of abutting the upper face of the bag portion 93 of the sub-tank 91, and is displaceable in accordance with the thickness of the bag portion 93 which varies in accordance with the remaining amount of the ink 97 (see FIG. 15 and FIG. 16). The remaining amount detection plate 691 includes a fixed plate portion 692, an elongated plate portion 693 and a shielding plate portion 694. The fixed plate portion 692 is located at the rear face at the upper end part of the left end part of the second wall portion 957. The fixed plate portion 692 is secured to the second wall portion 957 with the screw 699 so that the remaining amount detection plate 691 is secured to the sub-tank support portion 92.

The elongated plate portion 693 extends backward from the lower end of the fixed plate portion 692. The rear end part of the elongated plate portion 693 bends downwardly. The elongated plate portion 693 is a portion configured to abut the upper face of the bag portion 93. The position that the remaining amount detection plate 691 abuts the bag portion 93 is at the right side of the center part of the bag portion 93 in the right-left direction. Moreover, as shown in FIG. 7, in the state that the sub-tank support portion 92 is mounted onto the support plate portion 14, which will be described later, the position that the remaining amount detection plate 691 abuts the bag portion 93 is at the lower side of the center part of the bag portion 93 in the right-left direction. As shown in FIG. 12, FIG. 13 and FIG. 16, the first junction portion 931 of the bag portion 93 is located at the side of the second wall portion 957 which supports the remaining amount detection plate 691.

The shielding plate portion 694 extends upward from the rear end of the elongated plate portion 693. The upper end of the shielding plate portion 694 protrudes backward and is located between the light emitting portion 697 and the light receiving portion 698 of the optical detection portion 696. As the thickness of the bag portion 93 varies in accordance with the remaining amount of the ink 97 in the bag portion 93, the elongated plate portion 693 displaces in the up-down direction and the shielding plate portion 694 moves in the up-down direction. As shown in FIG. 12, FIG. 14 and FIG. 15, when the bag portion 93 has the thickness equal to or smaller than the prescribed thickness, then the upper part of the shielding plate portion 694 is situated on the optical path 670 (see FIG. 14 and FIG. 16) between the light emitting portion 697 and the light receiving portion 698 so as to shield the light from the light emitting portion 697. As a result, the light from the light emitting portion 697 is not received by the light receiving portion 698. On the other hand, as shown in FIG. 16, when the bag portion 93 has the thickness greater than the prescribed thickness, then the upper part of the shielding plate portion 694 moves to the upper side of the optical path 670 between the light emitting portion 697 and the light receiving portion 698 so as not to shield the light from the light emitting portion 697. As a result, the light from the light emitting portion 697 is received by the light receiving portion 698. The CPU detects whether the light receiving portion 698 receives the light or not so as to detect the thickness of the bag portion 93.

As shown in FIG. 13, the center of the front part of the support plate portion 95 in the right-left direction is provided with the wall portion 870 extending downward. At the lower right part of the wall portion 870, a second fixation portion 87 is formed recessed in the diagonally upper left direction. The second fixation portion 87 is a portion that fixes the sub-tank support portion 92 to the support plate portion 14.

Figure 17:
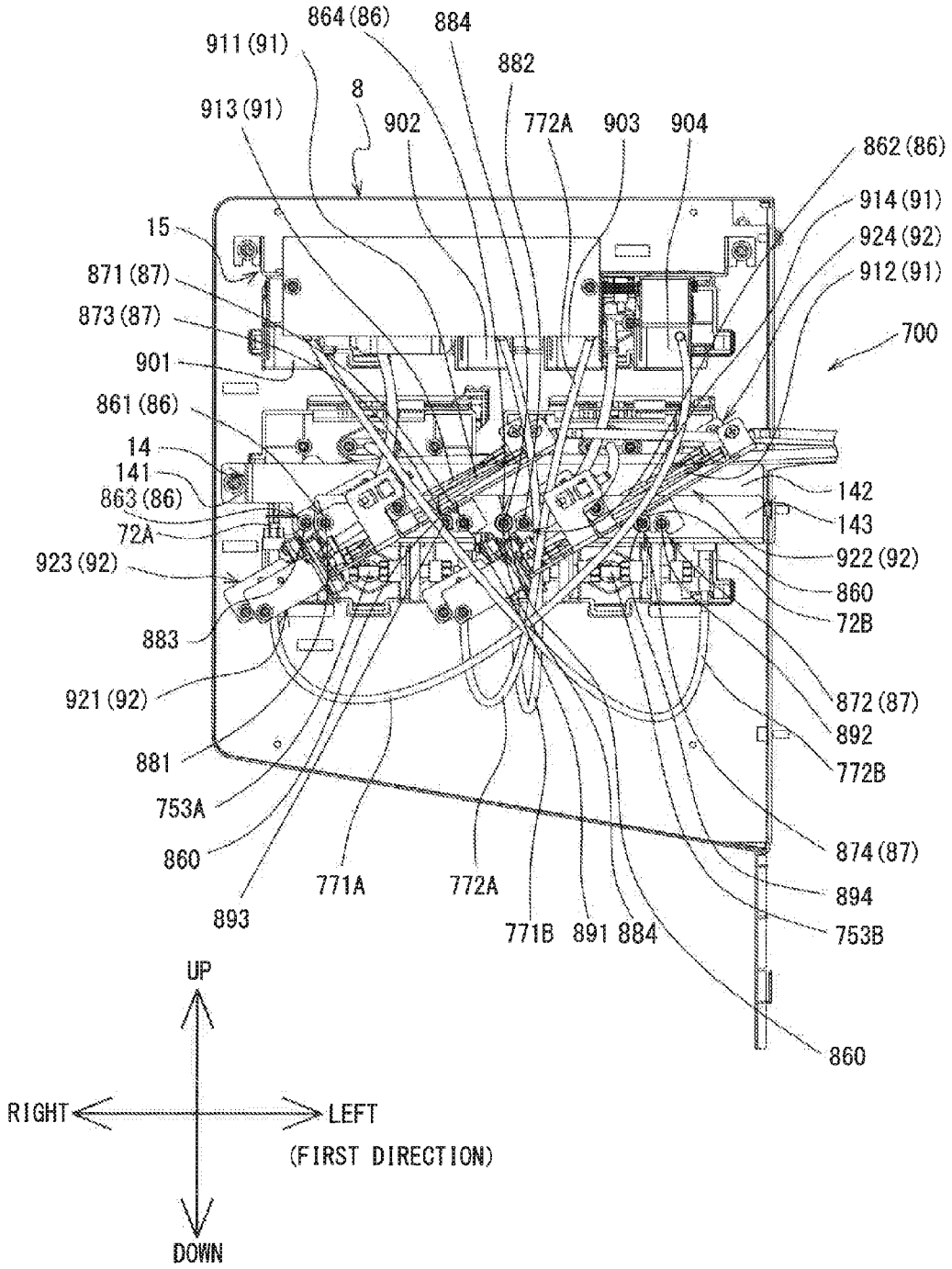
FIG. 17 is a rear view of a mount frame portion and an ink passage system.

As shown in FIG. 7, FIG. 8 and FIG. 17, the rear face 81 of the mount frame portion 8 is provided with the support plate portion 14. The support plate portion 14 supports the sub-tank support portion 92. The support plate portion 14 includes a first plate portion 141, a second plate portion 142, and a third plate portion 143. The first plate portion 141 extends backward from a position, the position being between the first mount portions 811 and 812 and the second mount portions 821 and 822 in the up-down direction, and being the right end part of the rear face 81 of the mount frame portion 8 in the right-left direction. The second plate portion 142 is connected to the rear end of the first plate portion 141 and extends in the right-left direction. Thus, the second plate portion 142 is situated in the rear direction of the mount frame portion 8. The third plate portion 143 extends in the right-left direction at the rear side of the second plate portion 142. The lower end of the right part of the third plate portion 143 is connected to the lower end of the right part of the second plate portion 142 with the plate portion extending in the front-rear direction (not shown). In addition, the left end part of the support plate portion 14 is supported by the frame member (not shown).

The four sub-tank supports 92 and the four sub-tanks 91 are arranged in two columns side by side in the right-left direction and in two tiers in the front-rear direction. The four sub-tanks 91 are assigned reference numerals 911, 912, 913 and 914, respectively (i.e., sub-tanks 911-914), in the following description. The four sub-tank supports 92 for supporting the four sub-tanks 911-914 are assigned reference numerals 921, 922, 923 and 924 (sub-tank supports 921-924), respectively.

As shown in FIG. 7, the sub-tank 913 and the sub-tank support 923 are situated behind the second mount portion 821 (see FIG. 6). The sub-tank 914 and the sub-tank support 924 are situated behind the second mount portion 822 (see FIG. 6). The sub-tank supports 923 and 924 connect to the second plate portion 142 of the support plate 14.

The sub-tank 911 and the sub-tank support 921 are situated behind the sub-tank 913 and the sub-tank support 923. The sub-tank 912 and the sub-tank support 922 are situated behind the sub-tank 914 and the sub-tank support 924. The third plate portion 143 of the support plate 14 is situated behind the sub-tank supports 923 and 924. The sub-tank supports 921 and 922 connect to the third plate 143, respectively. The sub-tank 91 and the sub-tank support 92 incline to the diagonally upward left direction relative to the horizontal plane.

As shown in FIG. 7 and FIG. 17, the sub-tanks 911 and 912 aligned in the first direction, out of a plurality of sub-tanks 91, are inclined such that a part of each of the sub-tanks 911 and 912 is located to progress upward towards the first direction, and the sub-tanks 911 and 912 are partially overwrapped each other in the up-down direction. Thus, the left part of the sub-tank 911 is located at the upper side of the right part of the sub-tank 912. Likewise, the sub-tanks 913 and 914 aligned in the first direction, out of a plurality of sub-tanks 91, are inclined such that a part of each of the sub-tanks 913 and 914 are located to progress upward towards the first direction, and the sub-tanks 913 and 914 are partially overwrapped each other in the up-down direction. Thus, the left part of the sub-tank 913 is situated at the upper side of the right part of the sub-tank 914.

As shown in FIG. 17, the sub-tanks 911 and 913 aligned in the second direction, out of a plurality of sub-tanks 91, are located such that the sub-tanks 911 and 913 are offset each other in the first direction. More particularly, the sub-tank 911 is located at the first direction side of the sub-tank 913 in the right-left direction. Likewise, the sub-tanks 912 and 914 aligned in the second direction, out of a plurality of sub-tanks 91, are located such that the sub-tanks 912 and 914 are offset each other in the first direction. More particularly, the sub-tank 912 is located at the first direction side of the sub-tank 914 in the right-left direction.

The first fixation portions 86 of the sub-tank support portions 921 to 924 are referred to as the first fixation portions 861 to 864, respectively. The second fixation portions 87 of the sub-tank support portions 921 to 924 are referred to as the second fixation portions 871 to 874, respectively. The sub-tank support portions 921 and 923 aligned in the second direction, out of a plurality of sub-tank support portions 92, are located such that the sub-tank support portions 921 and 923 are offset each other in the first direction. Also, the first fixation portions 861 and 863 of the sub-tank support portions 921 and 923 are located such that the first fixation portions 861 and 863 are offset each other in the first direction, and the second fixation portions 871 and 873 are located such that the second fixation portions 871 and 873 are offset each other in the first direction. More particularly, the first fixation portion 861 is located at the first direction side of the first fixation portion 863, and the second fixation portion 871 is located at the first direction side of the second fixation portion 873, in the right-left direction, respectively.

The sub-tank support portions 922 and 924 aligned in the second direction, out of a plurality of sub-tank support portions 92, are located such that the sub-tank support portions 922 and 924 are offset each other in the first direction. Also, the first fixation portions 862 and 864 of the sub-tank support portions 922 and 924 are located such that the first fixation portions 862 and 864 are offset each other in the first direction, and the second fixation portions 872 and 874 are located such that the second fixation portions 872 and 874 are offset each other in the first direction. More particularly, the first fixation portion 862 is located at the first direction side of the first fixation portion 864, and the second fixation portion 872 is located at the first direction side of the second fixation portion 874 in the right-left direction, respectively.

The first fixation portions 861 and 862 are secured to the third plate portion 143 of the support plate portion 14 with the screws 881 and 882. The first fixation portions 863 and 864 are secured to the second plate portion 142 of the support plate portion 14 with the screws 883 and 884. The second fixation portions 871 and 872 are secured to the third plate portion 143 of the support plate portion 14 with the screws 891 and 892. The second fixation portions 873 and 874 are secured to the second plate portion 142 of the support plate portion 14 with the screws 893 and 894. Hole portions 860 are provided that penetrate the third plate portion 143 in the front-rear direction, respectively, at a position located in the rear direction of the first fixation portion 864 and the second fixation portion 874 of the third plate portion 143. Thus, an operator can visually recognize the first fixation portion 864, the second fixation portions 873 and 874, and screws 884, 893 and 894 from the rear side through the hole portion 860. Further, as the first fixation portion 863 is situated at the right side with respect to the right end of the third plate portion 143 in the right-left direction, the operator can visually recognize the first fixation portion 863 from the rear side.

As shown in FIG. 7 and FIG. 17, a pump support portion 15 is provided towards the rear side from the rear face 81 of the mount frame portion 8. The pump support portion 15 is configured to support the pumps 901 to 904 (see FIG. 17). As shown in FIG. 17, four pumps 901 to 904 are aligned from the right side toward the left direction. It should be noted that, in FIG. 17, an illustration of the flow passage is omitted that connects the pumps 901 to 904 to the head portion 110.

The ink passage arrangement 700 will be described. As shown in FIG. 2 and FIG. 3, the ink passage arrangement 700 has reservoir passages 711-714 and non-reservoir passages 72A, 72B. FIG. 2 illustrates the fluid passages which are connected to the first mount portions 811 and 813 and the second mount portion 821 on the right column in FIG. 6. FIG. 3 illustrates the fluid passages which are connected to the first mount portions 812 and 814 and the second mount portion 822 on the left column in FIG. 6.

The reservoir passages 711 to 714 are the flow passages that connect the first mount portions 811 to 814 to the head portion 110 of the head unit 200, respectively, and that have sub-tanks 911 to 914. The reservoir passages 711 to 714 are flow passages that flow the color ink. The non-reservoir passages 72A and 72B are the flow passages that connect the second mount portions 821 and 822 to the head portion 110 of the head unit 100, respectively, and that have no sub-tanks 911 to 914. The non-reservoir passages 72A and 72B are the flow passages that flow the white ink.

The reservoir passages 711-714 will now be described. The reservoir passages 711-714 include fluid feed ports 611-614, first connection passages 621-624, second connection passages 631-634, and sub-tanks 911-914, respectively. The fluid feed ports 611-614 are provided behind the first mount portions 811-814 at the rear face 81 of the mount frame portion 8, respectively. The fluid feed ports 611-614 connect to the hollow needles (not shown) provided in the first mount portions 811-814 via fluid passages (not shown), respectively. The fluid feed ports 611-614 feed the ink 97 to the head portion 110 from the first mount portions 811-814.

As shown in FIG. 2, FIG. 3 and FIG. 7, one end of each of the first connection passages 621 to 624 is connected to the corresponding one of the fluid feed ports 611 to 614, respectively. The first connection passages 621 to 624 extend towards the sub-tanks 911 to 914 provided in the second region 212, respectively. As shown in FIG. 2, FIG. 7 and FIG. 8, the first connection passage 621 is the flow passage that connects one of the first mount portions 811 (see, FIG. 2) to one of the sub-tanks 911. The first connection passage 623 is a flow passage that connects the first mount portion 813 (see FIG. 2), which is located at the upper side of one of the first mount portions 811, to the sub-tank 913, which is located at the closer position to the mount portion 80 than one of the sub-tank 911 in the horizontal direction. The first connection passage 621 has the same length as the first connection passage 623.

As shown in FIG. 3 and FIG. 7, the first connection passage 622 is a flow passage that connects one of the first mount portion 812 (see FIG. 3) to one of the sub-tanks 912. The first connection passage 624 is a flow passage that connects the first mount portion 814 (see FIG. 3), which is located at the upper side of one of the first mount portion 812 to the sub-tank 914, which is located at the closer position to the mount portion 80 than one of the sub-tanks 912 in the horizontal direction. The first connection passage 622 has the same length as the first connection passage 624.

As shown in FIG. 12, the other ends of the first connection passages 621 to 624 are connected to the first connection port members 962 of the valve portions 96 of the sub-tank support portions 921 to 924, respectively. The flow inlets 941 of the sub-tanks 911 to 914 are connected to the second connection port members 963 of the valve portions 96 (see FIG. 13), respectively. Thus, the first connection passages 621 to 624 are linked to the flow inlets 941 of the sub-tanks 911 to 914.

As shown in FIG. 2, FIG. 3 and FIG. 7, one end of each of the second connection passages 631 to 634 is linked to the corresponding one of the flow outlets 942 of the sub-tanks 911 to 914, respectively. The other end of each of the second connection passages 631 to 634 is connected to the head portion 110 of the head unit 200, and linked to the nozzle arrays 121 to 124 of the nozzle face 111 (see FIG. 2 and FIG. 3).

Hereinafter, the non-reservoir passages 72A and 72B will be described below. As shown in FIG. 2, non-reservoir passage 72A is provided with a fluid feed port 73A, a branch portion 753A, and two filter portions 680A. As shown in FIG. 2 and FIG. 8, the fluid feed port 73A is provided at the rear side of the second mount portion 821 on the rear face 81 of the mount frame portion 8. The fluid feed port 73A is connected to the hollow needle provided at the second mount portion 821 through the flow passage (not shown). The fluid feed port 73A supplies the ink 97 to the head portion 110 side from the second mount portion 821.

As shown in FIG. 2, the non-reservoir passage 72A extends from the fluid feed port 73A, branches into two flow passages at the branch portion 753A, and is connected, through the filter portion 680A, to the nozzle arrays 121 and 122 of the head unit 100. The filter portion 680A has a disk-like shape so as to reduce the possibility that the extraneous substance immixed into the ink 97 would flow to the downstream side. Circulation passages 771A and 772A are connected to the downstream side of the filter portion 680A of the two flow passages into which the non-reservoir passage 72A is branched. The circulation passages 771A and 772A are provided with the pumps 904 and 903, respectively.

As shown in FIG. 3, the non-reservoir passage 72B includes a fluid feed port 73B, a branch portion 753B and two filter portions 680B. Moreover, the non-reservoir passage 72B is connected to circulation passages 771B and 772B. As those configuration are similar to the fluid feed port 73A, the branch portion 753A, two filter portions 680A, and circulation passages 771A and 772A, the description will be omitted. The fluid feed port 73B supplies the ink 97 to the head portion 110 side from the second mount portion 822. The non-reservoir passage 72B is connected to the nozzle arrays 123 and 124 of the head unit 100. The circulation passages 771B and 772B are provided with the pumps 902 and 901, respectively.

Hereinafter, the flow of the ink 97 will be described when the printing operation, the opening and closing operation of the valve portion 96, and the circulating operation are performed. The CPU (not shown) of the printer 1 controls the printer 1 according to a controlling program stored in a storing unit (not shown) so that the printing operation, the opening and closing operation of the valve portion 96, and the circulating operation are performed. The printing operation is an operation that performs printing by injecting the ink 97 from the nozzle face 111. The opening and closing operation of the valve portion 96 is an operation that supplies the ink 97 to the sub-tank 96. The circulating operation is an operation that circulates the white ink with the pumps 901 to 904 being activated.

As shown in an enlarged view W1 in FIG. 2, during the printing operation, a piezoelectric elements (not shown) provided at the head portion 110 are activated, and the ink 97 is injected from the nozzle 113 of the nozzle face 111. The operation injecting the ink 97 from the nozzle 113 serves as a pump which pulls the ink 97 towards the nozzle face 111 side. Thus, as shown in FIG. 2, the white ink is supplied, through the non-reservoir passage 72A, from the cartridge 301 to the nozzle arrays 121 and 122 of the head unit 100. Further, as shown in FIG. 3, the white ink is supplied, through the non-reservoir passage 72B, from the cartridge 302 to the nozzle arrays 123 and 124 of the head unit 100.

As shown in FIG. 2 and FIG. 3, the color ink are supplied from the cartridges 303 to 306 to the nozzle arrays 121 to 124 of the head unit 200, respectively, through the first connection passages 621 to 624, the valve portion 96 (see FIG. 12), the sub-tanks 911 to 914, and the second connection passages 631 to 634. When the valve portion 96 is closed, the color ink is supplied from the sub-tanks 911 to 914 to the nozzle arrays 121 to 124 of the head unit 200 through the second connection passages 631 to 634. It should be noted that during the printing operation, as the pumps 901 to 904 are not activated, the white ink in the circulation passages 771A, 772A, 771B, and 772B does not flow.

As shown in an enlarged view W2 in FIG. 2, when the printing is finished, the meniscus is created on the nozzle face 111 that causes the ink 97 to be recessed inward inside the nozzle 113 due to the surface tension. The meniscus allows the ink 97 to be held on the nozzle face 111.

Hereinafter, one example of the opening and closing operation of the valve portion 96 will be described. As shown in FIG. 14 and FIG. 15, when the bag portion 93 has a thickness equal to or less than the prescribed thickness, then a part protruding backward at the upper end of the shielding plate portion 694 is positioned on the optical path 670 between the light emitting portion 697 and the light receiving portion 698 so as to shield the light from the light emitting portion 697. At this moment, the CPU opens the valve portion 96 and supplies the ink 97 to the sub-tank 91 from the cartridge 3. Thus, the thickness of the bag portion 93 becomes thicker. As shown in FIG. 16, when the bag portion 93 becomes thicker than the prescribed thickness, then the part protruding backward at the upper end of the shielding plate portion 694 moves to the upper side of the optical path 670 between the light emitting portion 697 and the light receiving portion 698. As a result, the light form the light emitting portion 697 is received by the light receiving portion 698. The CPU closes the valve portion 96, when the prescribed time (for example, 10 seconds) elapses after it is detected that the light receiving portion 698 receives the light emitted from the light emitting portion 697.

Hereinafter, the circulating operation will be described. The pumps 901 to 904 are activated, under the control of the CPU, during the non-printing operation in which the ink 97 is not injected from the nozzle 113 so as to perform the circulating operation. When the circulating operation is performed, as shown with the arrow 90 in the FIG. 2 and FIG. 3, the ink 97 in the non-reservoir passages 72A and 72B are circulated through the circulation passages 771A, 772A, 771B and 771B. As a result, the white ink is stirred that is a high precipitation liquid.

As described above, the printer 1 according to the present embodiment can be configured. As shown in FIG. 17, according to the present embodiment, the sub-tanks 91 aligned in the first direction, out of a plurality of sub-tanks 91, are disposed diagonally such that the sub-tanks 91 are at least partially overwrapped each other in the up-down direction. With such configuration, a space in the horizontal direction required for locating a plurality of sub-tanks 91 can be reduced, as compared to the case that the part of the sub-tanks does not overwrap in the up-down direction. As a result, it can reduce the possibility that the printer 1 would become large sized.

The sub-tanks 91 aligned in the second direction, out of a plurality of sub-tanks 91, are located such that the sub-tanks 91 are offset each other in the first direction. Namely, as shown in FIG. 17, the sub-tanks 91 aligned in the second direction are offset each other in the first direction, in the state that the sub-tanks 91 are arranged diagonally. Thus, the operator can easily confirm each of the sub-tanks 91 aligned in the second direction with the visual observation, as compared to the case that the sub-tanks 91 are not offset. In other words, each of the sub-tanks 91 can be easily confirmed with the visual observation, while keeping the space of the sub-tanks 91 in the horizontal direction smaller. As a result, for example, the operator can easily confirm the amount of the ink 97 in the sub-tank 91 with the visual observation. Also, the operator can easily confirm whether the connection of the sub-tanks 91 to the sub-tank support portion 92 is appropriate or not with the visual observation.

As shown in FIG. 17, the first fixation portions 86 provided at the sub-tank support portions 92 aligned in the second direction, out of a plurality of sub-tank support portions 92, are located such that the first fixation portions 86 are offset each other in the first direction. Thus, the first fixation portions 86 do not overwrap each other in the second direction. Likewise, the second fixation portions 87 provided at the sub-tank support portions 92 aligned in the second direction, out of a plurality of sub-tank support portions 92, are located such that the second fixation portions 87 are offset each other in the first direction. Thus, the second fixation portions 87 do not overwrap each other in the second direction. As a result, fixing operation can be performed easily that secures the sub-tank support portion 92 with the first fixation portion 86 and the second fixation portion 87 from the second direction side. In other words, the fixing operation can be easily performed that secures the sub-tanks support portion 92, even in the state that the space in the horizontal direction required for arranging the sub-tanks 91 is reduced and smaller operational space is realized.

As the bag portion 93 of the sub-tank 91 is inclined with respect to the horizontal direction, the space in the horizontal direction can be smaller, as compared to the case that the bag portion 93 is not inclined. Also, in the bag portion 93, the flow outlet 942 are situated at upper side of the flow inlet 941. Thus, a gas existing in the bag portion 93 is more likely to be discharged from the flow outlet 942 towards the downstream side in response to filling the sub-tank 91, which has not been filled with the ink 97, with the ink 97, as compared to the case that the flow outlet 942 and the flow inlet 941 are aligned in the horizontal direction or the case that the flow outlet 942 is positioned at the lower side of the flow inlet 941. Accordingly, it is possible to reduce the possibility that the gas would be immixed into the ink 97. As a result, it is possible to reduce the possibility that the printing quality would be deteriorated due to the immixture of the gas into the ink 97.

The gas existing in the bag portion 93 is guided by the tapered portions 934 and 935 (see FIG. 10) and then discharged, in response to filling the sub-tank 91, which has not been filled with the ink 97, with the ink 97. As a result, the gas can be discharged from the bag portion 93 in a more assured manner, as compared to the case that the tapered portions 934 and 935 are not provided.

As the bag portion 93 is diagonally disposed, the space in the horizontal direction can be smaller. As the bag portion 93 is formed with the film, the displacement amount, which is caused by inflating and deflating the bag portion 93 in accordance with the remaining amount of the ink 97, is larger in the part at the lower side of the center of the bag portion 93 in the up-down direction than in the part at the upper side of the center in the up-down direction. As shown in FIG. 12, according to the present embodiment, the remaining amount detection plate 691 abuts a part at the lower side of the center part of the bag portion 93 in the up-down direction. Thus, the displacement amount of the remaining amount detection plate 691 becomes larger, as compared to the case that the remaining amount detection plate 691 abuts at the upper side of the center of the bag portion 93 in the up-down direction. As a result, the remaining amount of the ink 97 can be detected in a more assured manner, while keeping the space in the horizontal direction smaller with the bag portion 93 being disposed diagonally.

As shown in FIG. 12, FIG. 15 and FIG. 16, the first junction portion 931 of the bag portion 93 is located at the second wall portion 957 side for supporting the remaining amount detection plate 691. The rear part, which is a part opposite to the first junction portion 931 in the bag portion 93, is more likely to inflate than a part at the first junction portion 931 side (see FIG. 16). Thus, for example, when the rear part of the bag portion 93 is located at the second wall portion 957 side, the rear part of the bag portion 93, which is more likely to inflate, becomes closer to the front part that is a part to which the remaining amount detection plate 691 is secured. The front part of the remaining amount detection plate 691 is secured so that the front part is hardly to move in the up-down direction, as compared to the rear part. Thus, the inflated bag portion 93 becomes the state that the inflated bag portion 93 is pressed by the remaining amount detection plate 691 so that the accuracy for detecting the remaining amount may be reduced. According to the present embodiment, the first junction portion 931 is located at the second wall portion 957 side. Thus, the rear part of the bag portion 93, which is likely to inflate, becomes distant from the part to which the remaining amount detection plate 691. As a result, the inflated bag portion 93 becomes hardly to be pressed by the remaining amount detection plate 691. Therefore, it is possible to reduce the possibility that the accuracy for detecting the remaining amount would become lower.

As shown in FIG. 7, the sub-tanks 911 to 914 are arranged in line in the horizontal direction in the state that the sub-tanks 911 to 914 are diagonally disposed. The sub-tanks 911 to 914 align in the horizontal direction, the first mount portions 811 and 813 (see FIG. 6) align in the up-down direction, and the first mount portions 812 and 814 align in the up-down direction (see FIG. 6). Thus, the distance between each of the sub-tanks 911 to 914 and the corresponding one out of the first mount portions 811 to 814 is different from each other.

The first connection passage 621 connects one of the first mount portions 811 to one of the sub-tanks 911. The first connection passage 623 connects the first mount portion 813, which is located above the one of the first mount portions 811, to the sub-tank 913, which is located at the closer position to the mount portion 80 than the one of the sub-tanks 911 in the horizontal direction. As a result, it make it possible that the first connection passage 621 has the same length as the first connection passage 623. Likewise, the first connection passage 622 connects one of the first mount portions 812 to one of the sub-tanks 912. The first connection passage 624 connects the first mount portion 814, which is located above the one of the first mount portions 812, to the sub-tank 914, which is located at the closer position to the mount portion 80 than the one of sub-tanks 912 in the horizontal direction. As a result, it make it possible that the first connection passage 622 has the same length as the first connection passage 624. In other words, by utilizing the difference in position of a plurality of first mount portions 811 to 814 in the up-down direction, and also the difference in position of a plurality of sub-tanks 911 to 914 in the horizontal direction, it is possible to have the first connection passage 621 and the first connection passage 623 be the same length, and likewise the first connection passage 622 and the first connection passage 624 be the same length. Thus, a common component can be implemented to both the first connection passage 621 and the first connection passage 623, and also to both the first connection passage 622 and the first connection passage 624. As a result, the common component can be used to reduce the manufacturing cost, while keeping the space smaller for locating the sub-tanks 911 to 914 in the horizontal direction. It should be noted that, according to the present embodiment, all of first connection passages 621 to 624 can be implemented with the common components.

As shown in FIG. 2 and FIG. 3, the second mount portions 821 and 822 and sub-tank 91 are provided in the second region 212. Thus, the head difference of the ink 97 based on the positions between the sub-tanks 91 and the nozzle face 111 is substantially similar to the head difference of the ink 97 based on the second mount portions 821 and 822 and the nozzle face 111. Accordingly, the ink 97 can be held accurately due to the meniscus on the nozzle face 111 so that the injection failure of the ink 97 is hardly to occur. As a result, it is possible to reduce the possibility that the printing quality would be deteriorated. It should be noted that the sub-tank 91 is inclined diagonally with respect to the horizontal plane and the upper end of the sub-tank 91 is situated at somewhat upper side of the second region 212. On the other hand, the head of the ink 97 in the sub-tank 91 is inside the second region 212. Also, in the cartridges 301 and 302, the shaft portion 43 shown in FIG. 5 is biased in the rear direction by the resilient member 45 to wind up the liquid container bag 13. For this reason, the pressure for ejecting the ink 97 from the liquid container bag 13 is higher, as compared to the case that none of the resilient member 45 nor the shaft portion 43 is provided. Accordingly, the head of the ink 97 within the liquid container 31 in the cartridges 301 and 302 is above the second mount portions 821 and 822, and inside the second region 212.

The non-reservoir passages 72A and 72B are not provided with the sub-tanks 91. In other words, the sub-tank 91 is provided on only a part of flow passages, out of the flow passages extending to the head portion 110 from a plurality of the mount portions 80, respectively. For this reason, the number of components can be reduced, as compared to the case that the sub-tanks 91 are provided at all of the flow passages extending to the head portion 110 from a plurality of the mount portions 80, respectively.

It should be noted the present disclosure is not limited to those disclosed in the above mentioned embodiments, but various modification can be made. For example, the white ink may not be high precipitation liquid. Also, the liquid injected from the nozzle face 111 is not limited to the ink 97. Instead, for example, it may be a dye-discharging material for decolorizing the color dying the fabric. Also, non-reservoir passages 72A and 72B may not be provided. Also, the circulation passages 771A, 772A, 771B, 772B and pumps 901 to 904 may not be provided. Furthermore, the shaft portion 43 and the resilient member 45 (see FIG. 5) of the cartridge 3 may not be provided.

The numbers of the mount portions 80 and the sub-tanks 91 are not limited in this regard. Instead, for example, the numbers may be equal to or greater than five, respectively. In this case, similar to the case of first connection passages 621 to 624, a mount portion arranged at the upper side of one of mount portions, one first connection passage configured to connect the sub-tank located at the closer side to the mount portion than one of sub-tanks 91 in the horizontal direction, and the other first connection passage configured to connect the one of mount portions to the one of sub-tanks 91 can be provided. With employing those configuration, a plurality of first connection passages can be of the same length, and the common components can be used. Instead, the first connection passages 621 to 624 may have a different length each other.

The first connection passage 931 of the bag portion 93 (see FIG. 16) may be located at the opposite side to the second wall portion 957 side in the support plate 95. Also, the tapered portions 934 and 935 may not be provided. Also, the bag portion 93 may be a bag-like container which is formed by overwrapping two sheets of flexible resin films having a rectangular shape in the state that respective surfaces are facing each other and joining the peripheral parts with thermal seal. Also, the contact position that the remaining amount detection plate 691 (see FIG. 12) abuts the bag portion 93 may be in the center part of the bag portion 93 in the up-down direction, or alternatively at the upper side of the center part of the bag portion 93 in the up-down direction. Also, the detection portion 69 may not be provided.

The flow outlet 942 and the flow inlet 941 may be aligned in the horizontal direction. Alternatively, the flow outlet 942 may be below the flow inlet 941. Also, the first fixation portions 86, which are provided at the sub-tank support portion 92 and aligned in the second direction, may not offset one another in the first direction. Likewise, the second fixation portions 87, which are provided at the sub-tank support portion 92 and aligned in the second direction, may not offset one another in the first direction. Also, only one of either the first fixation portion 86 or the second fixation portion 87 may be provided. Alternatively, neither the first fixation portion 86 nor the second fixation portion 87 may be provided. Also, the sub-tanks 91 aligned in the second direction may not be offset one another in the first direction. The valve portion 96 may not be provided, and the first connection passages 621 to 624 may be directly connected to the flow inlets 941 of the sub-tanks 911 to 914, respectively. Also, the engagement portion 854 may not be disposed at the flow inlet 941.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head portion including a first nozzle and a second nozzle, each of the first nozzle and the second nozzle being configured to inject liquid, the first nozzle being provided at a first nozzle face, and the second nozzle being provided at a second nozzle face;

a plurality of mount portions, each of the plurality of the mount portions being configured to mount a container containing the liquid;

a plurality of flow passages, each of the plurality of the flow passages being configured to connect each of the plurality of the mount portions to the head portion; and a plurality of reservoir portions configured to reserve the liquid, each of the plurality of the reservoir portion being provided on each of the plurality of the flow passages, each of the plurality of the reservoir portions being located such that a distance from the first nozzle face and the second nozzle face in an up-down direction be within a prescribed range, the plurality of reservoir portions including a first reservoir portion and a second reservoir portion, the first reservoir portion being configured to connect the first nozzle via the flow passage, the second reservoir portion being configured to connect the second nozzle via the flow passage, the first nozzle face and the second nozzle face being provided at a same height in the up-down direction, the first reservoir portion and the second reservoir portion being aligned in a first direction in a horizontal direction, the first reservoir portion being inclined such that a part of the first reservoir portion is situated to progress upward towards the first direction, the second reservoir portion being inclined such that a part of the second reservoir portion is situated to progress upward towards the first direction, and the first reservoir portion and the second reservoir portion being arranged such that the first reservoir portion and the second reservoir portion are at least partially overwrapped each other in the up-down direction.

2. The print device according to claim 1, wherein the first reservoir portion and a third reservoir portion out of the plurality of the reservoir portions are aligned in a second direction orthogonal to the first direction in the horizontal direction, wherein the first reservoir portion and the third reservoir portion are arranged such that the first reservoir portion and the third reservoir portion are offset each other in the first direction, and wherein the third reservoir portion is inclined such that a part of the third reservoir portion is situated to progress upward towards the first direction.

3. The print device according to claim 2 further comprising:

a plurality of support plates, each of the plurality of the support plates being configured to support each of the plurality of the reservoir portions;

a plurality of wall portions each being erected from an end part of each of the plurality of the support plates; and a plurality of fixation portions each provided at the wall portion of each of the plurality of the support plates and configured to secure the support plate to other member, wherein one of fixation portions provided at one of support plates supporting the first reservoir portion and the other of fixation portions provided at the other of support plates supporting the third reservoir portion are arranged to be offset each other in the first direction.

4. The print device according to claim 3, wherein the reservoir portion comprises:

a bag portion made of a flexible film and configured to internally reserve the liquid, the bag portion being inclined such that a part of the bag portion is situated to progress upward towards the first direction;

an flow inlet provided at an end part at an opposite direction side to the first direction of the bag portion and configured to flow the liquid into the bag portion; and an flow outlet provided at an end part at the first direction side of the bag portion and configured to drain the liquid out of the bag portion, and wherein the flow outlet is located at an upper side of the flow inlet in the up-down direction.

5. The print device according to claim 4, further comprising a tapered portion provided at an end part at the flow outlet side of the bag portion, wherein the tapered portion is formed such that a width of a space inside the bag portion becomes smaller towards the flow outlet side from the flow inlet side.

6. The print device according to claim 4 further comprising a remaining amount detection portion provided to abut an upper face of the bag portion, wherein the remaining amount detection portion is configured to displace in accordance with a thickness of the bag portion, the thickness of the bag portion varying in accordance with a remaining amount of the liquid, and wherein a contact position of the remaining amount detection portion to the bag portion is at a lower side of a center of the bag portion in the up-down direction.

7. The print device according to claim 6 further comprising a support portion provided at an end part of the support plate and configured to support the remaining amount detection portion, wherein the bag portion is formed by folding one sheet of the film, the bag portion includes a junction portion being a portion to which end parts, facing each other, of the one sheet of the film are jointed, the junction portion extending in a direction towards the flow outlet side from the flow inlet side, and the junction portion is situated at the support portion side of the support plate.

8. The print device according to claim 1, wherein an upper mount portion out of the plurality of the mount portions and a lower mount portion out of the plurality of the mount portions are arranged to be aligned in the up-down direction at an upper side of the plurality of the reservoir portions aligned in the horizontal direction, the plurality of the passages includes a first passage and a second passage, the first passage is configured to connect the upper mount portion located at an upper side of the lower mount portions to the reservoir portion located at a closer side to the plurality of the mount portions than one of the reservoir portions in the horizontal direction; and the second passage configured to connect the lower mount portions to the one of the reservoir portions, and the first passage has the same length as the second passage.

9. The print device according to claim 1, wherein the plurality of mount portions include a first mount portion configured to mount a first container containing the liquid and a second mount portion configured to mount a second container containing the liquid, the first container being different from the second container, and the first reservoir portion is configured to connect the first mount portion via the flow passage and the second reservoir portion is configured to connect the second mount portion via the flow passage.

10. The print device according to claim 1, wherein the first reservoir portion is disconnected from the second reservoir portion.

* * * * *